US009452520B2

(12) United States Patent
Sawano et al.

(10) Patent No.: US 9,452,520 B2
(45) Date of Patent: Sep. 27, 2016

(54) ELECTRIC POWER TOOL

(71) Applicant: Panasonic Corporation, Osaka (JP)

(72) Inventors: Fumiaki Sawano, Mie (JP); Hiroshi Miyazaki, Mie (JP); Hidenori Shimizu, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 435 days.

(21) Appl. No.: 14/197,822

(22) Filed: Mar. 5, 2014

(65) Prior Publication Data

US 2014/0262404 A1 Sep. 18, 2014

(30) Foreign Application Priority Data

Mar. 13, 2013 (JP) ..... 2013-050146

(51) Int. Cl.

| | |
|---|---|
| ***B25F 5/00*** | (2006.01) |
| ***B25B 21/00*** | (2006.01) |
| ***B25B 23/14*** | (2006.01) |
| ***B25B 23/147*** | (2006.01) |

(52) U.S. Cl.

CPC ..... *B25F 5/001* (2013.01); *B25B 21/00* (2013.01); *B25B 23/141* (2013.01); *B25B 23/147* (2013.01)

(58) Field of Classification Search

CPC ..... B25F 5/002
USPC ..... 173/176, 178, 217; 192/48.1, 56.4; 475/269

See application file for complete search history.

(56) References Cited

U.S. PATENT DOCUMENTS 5,967,934 A * 10/1999 Ishida ..... F16H 3/66 475/269
6,076,438 A * 6/2000 Rahm ..... B25B 13/48 173/176
6,662,882 B2 * 12/2003 Hansson ..... B23Q 11/04 173/176
2003/0221928 A1 12/2003 Koslowski
2009/0308628 A1 * 12/2009 Totsu ..... B25B 21/00 173/176
2011/0017484 A1 * 1/2011 Roehm ..... B23B 45/008 173/178

FOREIGN PATENT DOCUMENTS

| | | |
|---|---|---|
| EP | 1358969 | 11/2003 |
| JP | 2000-015586 A | 1/2000 |
| JP | 2012-130989 | 7/2012 |

OTHER PUBLICATIONS

European Search Report for corresponding European Application No. 14157805.4 dated Mar. 6, 2015.

* cited by examiner

*Primary Examiner* — Nathaniel Chukwurah
(74) *Attorney, Agent, or Firm* — Renner, Otto, Boisselle & Sklar, LLP

(57) ABSTRACT

An electric power tool includes a motor having a drive shaft, a tool output shaft rotated by rotational force of the drive shaft, a clutch unit that connects or disconnects a torque transmission line between the drive shaft and the tool output shaft according to load torque of the tool output shaft, a load detector that outputs a load torque signal in accordance with the load torque of the tool output shaft, and a control unit that performs a rising detection mode, which detects rising of the load torque signal to stop rotation of the motor, and a falling detection mode, which detects falling of the load torque signal to stop rotation of the motor. The control unit selects the rising detection mode or the falling detection mode according to a usage condition signal indicating a usage condition of the electric power tool.

9 Claims, 9 Drawing Sheets

ELECTRIC POWER TOOL

CROSS-REFERENCE TO RELATED APPLICATIONS

This application is based upon and claims the benefit of priority from prior Japanese Patent Application No. 2013-050146, filed on Mar. 13, 2013, the entire contents of which are incorporated herein by reference.

FIELD

The present invention relates to an electric power tool.

BACKGROUND

Japanese Laid-Open Patent Publication No. 2000-15586 discloses an example of a conventional electric power tool. The electric power tool of the publication (refer to FIGS. 1 and 6 of the publication) includes a gear case (8), a motor, a ring gear (23), a planet gear (29), a carrier (30), an output shaft (9), a torque clutch, a clutch sensor (S), and a shutoff circuit. The torque clutch includes a ring gear protrusion (32), a ball (33), a clutch plate (36), and a clutch spring (37).

The motor rotates the planet gear. The planet gear engages with the ring gear. A pin of the carrier is inserted into the planet gear. The carrier is coupled to the output shaft and rotated integrally with the output shaft. The clutch spring applies a load to the ring gear via the clutch plate and the ball.

When a load torque acting on the output shaft is less than a predetermined torque, the rotation of the ring gear with respect to the gear case is restricted by the load input from the clutch spring. When the load torque acting on the output shaft is greater than or equal to the predetermined torque, the ring gear is rotate relative to a housing by a torque input from the planet gear. Thus, when the load torque is greater than or equal to the predetermined torque, the planet gear does not input torque to the carrier. Accordingly, the torque of the motor is not transmitted to the output shaft. When the load torque is greater than or equal to the predetermined torque, the torque clutch disconnects a torque transmission line between the motor and the output shaft.

When the ring gear rotates relative to the gear case, the ball is moved by the protrusion of the ring gear. This moves the clutch plate. The clutch sensor outputs a signal when the clutch plate moves. The shutoff circuit outputs a motor stop signal when the signal of the clutch sensor rises. The motor stops rotation in response to the motor stop signal.

SUMMARY

The inventors of the present invention have noticed the following shortcoming of the conventional electric power tool. In the electric power tool of the publication, when the motor stops rotation in response to the signal of the clutch sensor, the load torque may vary. The variation in the load torque is assumed to occur for the following reason.

When the torque clutch disconnects the torque transmission line between the motor and the output shaft, the protrusion is moved by the rotation of the ring gear to move the ball. This also moves the clutch plate. The movement of the clutch plate compresses the clutch spring.

Thus, compared to when the protrusion does not move the ball, the load applied to the ring gear is increased by the clutch spring. In this case, the ring gear does not rotate or hardly rotates relative to the gear case. As a result, the planet gear transmits the torque to the output shaft via the carrier. This increases the load torque acting on the output shaft.

An increase amount in the load torque during rotation of the ring gear is correlated with the rotation amount of the ring gear after the supply of current to the motor is interrupted. The rotation amount is affected by the usage condition of the electric power tool. An example of the usage condition of the electric power tool is the rotation speed of the motor before the output of the motor stop signal. The rotation amount of the ring gear increases as the rotation speed of the motor rises. Thus, the load torque when the motor stops rotation can vary according to the rotation speed of the motor before the output of the motor stop signal.

In the electric power tool of the publication, the relationship between the increase amount of the load torque during rotation of the ring gear and the usage condition of the electric power tool is not considered. Thus, in the electric power tool of the publication, the load torque when the motor stops rotation changes according to changes in the usage condition of the electric power tool. As a result, the load torque varies when the motor stops rotation.

Paragraph 0019 of the publication describes "in terms of fastening of a screw, when the load suddenly increases simultaneously with seating of the screw as in a terminal screw, it is preferable to stop the motor according to rising detection, and when the load gradually increases from immediately before seating of the screw as in a wood screw, it is preferable that the motor be stopped according to a pulse detection. Accordingly, when using a control circuit F formed by microcomputer, the control circuit F may switch between stopping the motor when a torque clutch operation detection signal rises and stopping the motor when a torque clutch operation detection signal falls". However, the publication does not consider control that switches between the motor stopping modes in a further preferable manner. Therefore, when the motor stops rotation, the load torque may vary.

One aspect of the present invention is an electric power tool including a motor, a tool output shaft, a clutch unit, a load detector, and a control unit. The motor includes a drive shaft. The tool output shaft is rotated by rotational force of the drive shaft. The clutch unit connects or disconnects a torque transmission line between the drive shaft and the tool output shaft in accordance with a load torque of the tool output shaft. The load detector outputs a load torque signal in accordance with the load torque of the tool output shaft. The control unit is capable of performing a rising detection mode, which stops rotation of the motor when detecting a rising in the load torque signal, and a falling detection mode, which stops rotation of the motor when detecting a falling in the load torque signal. The control unit selects the rising detection mode or the falling detection mode based on a usage condition signal indicating a usage condition of the electric power tool.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

First Embodiment

Figure 1:
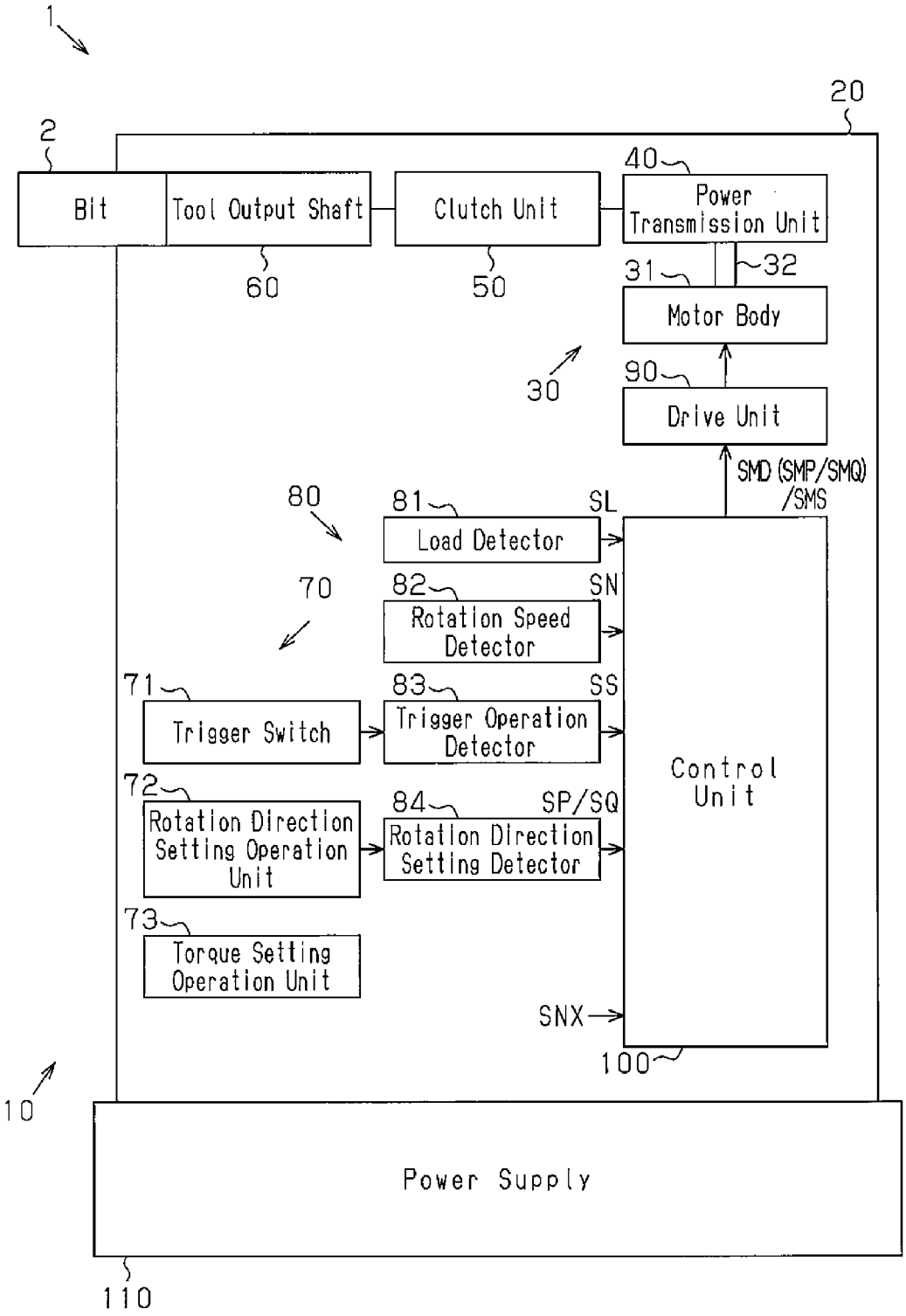
FIG. 1 is a block diagram of an electric power tool in a first embodiment.

FIG. 1 shows an electric power tool 1 of a first embodiment.

The electric power tool 1 is, for example, a drill driver. The electric power tool 1 includes an electric power tool body 10 and a power supply 110. The power supply 110 is connected in a removable manner to the electric power tool body 10. The electric power tool 1 transmits torque to a working subject through a bit 2 connected to the electric power tool body 10. The working subject is, for example, a screw or a bolt.

The electric power tool body 10 includes a housing 20, a motor 30, a power transmission unit 40, a clutch unit 50, a tool output shaft 60, an operation unit 70, a detection unit 80, a drive unit 90, and a control unit 100. The bit 2 is connected in a removable manner to the electric power tool body 10. The electric power tool body 10 includes a power block driven by electric power supplied from the power supply 110. The power block includes the motor 30, the detection unit 80, the drive unit 90, and the control unit 100.

Figure 2:
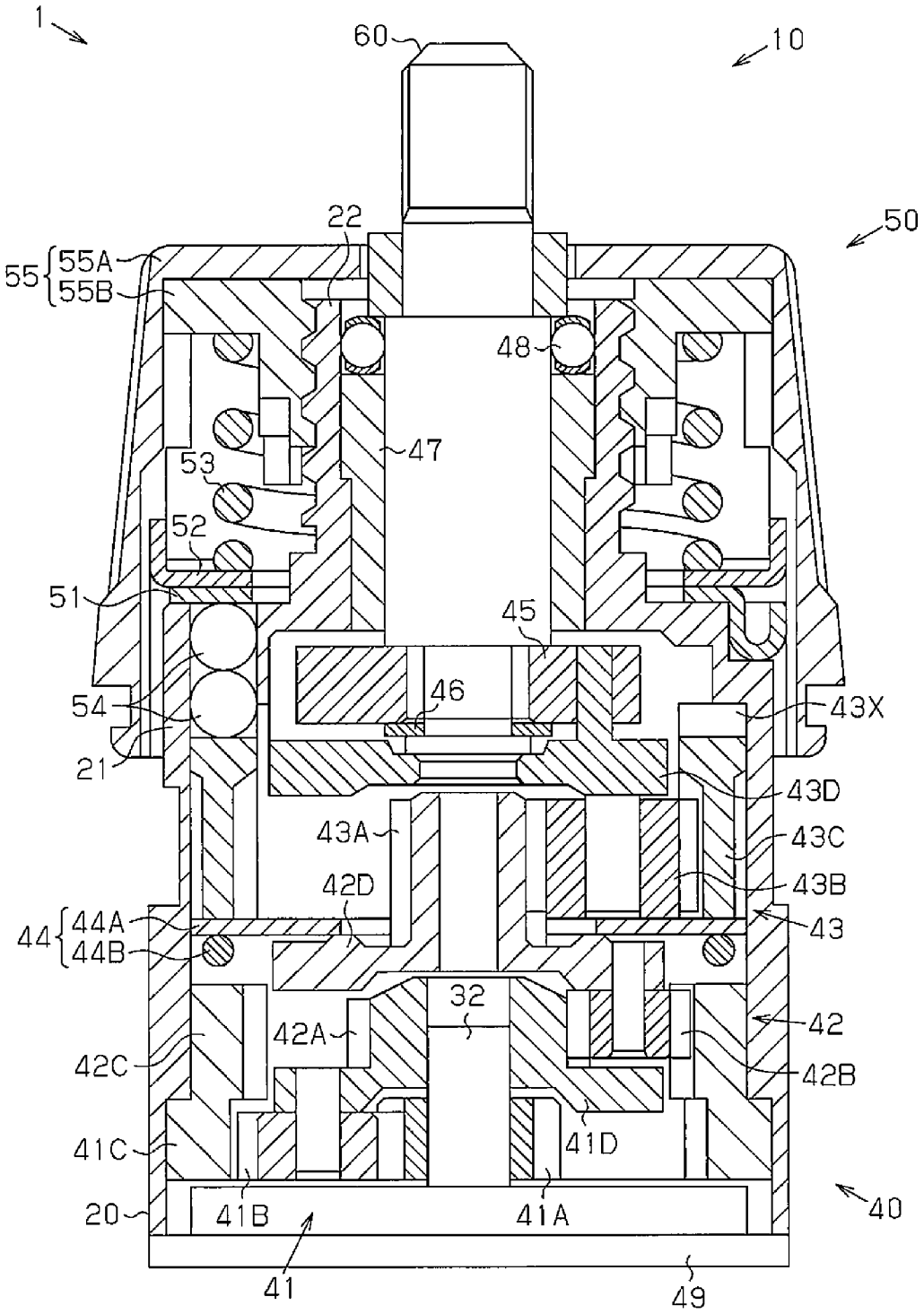
FIG. 2 is a cross-sectional view of the electric power tool in the first embodiment.

The housing 20 is shaped to allow for gripping by a user. The housing 20 stores components of the electric power tool body 10. The housing 20 forms part of the power transmission unit 40 and part of the clutch unit 50. The housing 20 includes an accommodation portion 21 and a threaded portion 22 as shown in FIG. 2. The accommodation portion 21 and the threaded portion 22 form part of the clutch unit 50.

The motor 30 is located in the housing 20. The motor 30 includes a motor body 31 and a tool drive shaft 32, which is an output shaft of the motor 30. The motor 30 is driven by electric power supplied from the drive unit 90. The motor 30 is controlled in a forward rotation mode and a reverse rotation mode. In the forward rotation mode, the motor 30 rotates the tool drive shaft 32 in the forward direction. In the reverse rotation mode, the motor 30 rotates the tool drive shaft 32 in the reverse direction.

The power transmission unit 40 is located in the housing 20. The power transmission unit 40 decelerates the rotation of the tool drive shaft 32, and transmits the decelerated rotation to the tool output shaft 60. For example, the power transmission unit 40 includes a plurality of planet gear mechanisms 41 to 43 shown in FIG. 2.

The clutch unit 50 is located near the tool output shaft 60. The clutch unit 50 connects and disconnects the torque transmission line between the tool drive shaft 32 and the tool output shaft 60. For example, the clutch unit 50 includes a detection component 51 and a rear-stage annular gear 43C in FIG. 2. The clutch unit 50 connects the torque transmission line between the tool drive shaft 32 and the tool output shaft 60 when a load torque TL acting on the tool output shaft 60 is less than a disconnection torque TX. The clutch unit 50 disconnects the torque transmission line between the tool drive shaft 32 and the tool output shaft 60 when the load torque TL is greater than or equal to the disconnection torque TX.

The tool output shaft 60 includes a portion located in the housing 20 and a portion exposed from the housing 20. The tool output shaft 60 rotates the bit 2 with torque transmitted through the power transmission unit 40 and the clutch unit 50. The tool output shaft 60 varies the torque acting on the working subject (hereinafter referred to as "tightening torque TC").

The operation unit 70 includes a trigger switch 71, a rotation direction setting operation unit 72, and a torque setting operation unit 73. The user operates the operation unit 70 to change the usage condition of the electric power tool 1. Each of the trigger switch 71, the rotation direction setting operation unit 72, and the torque setting operation unit 73 is an example of a condition setting operation unit.

The trigger switch 71 takes the form of a human-machine interface. The trigger switch 71 is used to adjust the output of the motor 30. The user may continuously operate the trigger switch 71 in a range from an output stop position to a maximum output position. The amount the trigger switch 71 is pulled is the smallest at the output stop position and the largest at the maximum output position.

The rotation direction setting operation unit 72 takes the form of a human-machine interface. The rotation direction setting operation unit 72 is used to set the rotational direction of the tool output shaft 60. The user may set the rotation direction setting operation unit 72 to a forward rotation position or a reverse rotation position. When the rotation direction setting operation unit 72 is set to the forward rotation position, the motor 30 rotates in the forward direction. When the rotation direction setting operation unit 72 is set to the reverse rotation position, the motor 30 rotates in the reverse direction.

The torque setting operation unit 73 includes, for example, a load adjustment section 55 shown in FIG. 2. The torque setting operation unit 73 is set to adjust the level of the disconnection torque TX. The user can operate the torque setting operation unit 73 in steps within a range from a minimum adjustment position to a maximum adjustment position.

When the torque setting operation unit 73 is set to the minimum adjustment position, the disconnection torque TX is set to a minimum value. When the torque setting operation unit 73 is set to the maximum adjustment position, the disconnection torque TX is set to a maximum value. The disconnection torque TX is adjusted by a load input component 53 shown in FIG. 2.

The detection unit 80 includes a load detector 81, a rotation speed detector 82, a trigger operation detector 83, and a rotation direction setting detector 84. The detection unit 80 generates a voltage signal according to an operation signal supplied from the operation unit 70. Each of the load detector 81, the rotation speed detector 82, the trigger operation detector 83, and the rotation direction setting detector 84 is an example of a condition setting detector. A signal output from each of the detectors 81 to 84 corresponds to a usage condition signal.

The load detector 81 indirectly detects the load torque TL acting on the tool output shaft 60. The load detector 81 includes, for example, a photointerruptor. The load detector 81 detects the load torque TL from the movement of the detection component 51 (clutch unit 50). Then, the load detector 81 provides the control unit 100 with a load torque signal SL corresponding to the movement of the detection component 51.

The rotation speed detector 82 detects the rotation of the tool drive shaft 32 for a certain time (hereinafter referred to as "drive shaft rotation speed NM"). The rotation speed detector 82 provides the control unit 100 with a rotation speed detection signal SN corresponding to the drive shaft rotation speed NM.

The trigger operation detector 83 detects the operation position of the trigger switch 71. The trigger operation detector 83 provides the control unit 100 with a trigger operation signal SS corresponding to the operation position of the trigger switch 71. When the trigger switch 71 is located at an operation position other than the output stop position, the trigger operation detector 83 provides the control unit 100 with the trigger operation signal SS having a control value corresponding to the operated amount of the trigger switch 71. When the trigger switch 71 is located at the output stop position, the trigger operation detector 83 does not output the trigger operation signal SS.

The rotation direction setting detector 84 detects the operation position of the rotation direction setting operation unit 72. The rotation direction setting detector 84 provides the control unit 100 with a signal corresponding to the operation position of the rotation direction setting operation unit 72. When the rotation direction setting operation unit 72 is located at the forward rotation position, the rotation direction setting detector 84 provides the control unit 100 with a forward direction setting signal SP. When the rotation direction setting operation unit 72 is located at the reverse rotation position, the rotation direction setting detector 84 provides the control unit 100 with a reverse direction setting signal SQ.

The drive unit 90 operates in accordance with signals provided from the control unit 100. When receiving a rotation driving signal SMD from the control unit 100, the drive unit 90 changes the level of the electric power supplied to the motor 30 by performing a switching operation. When receiving a forward rotation driving signal SMP from the control unit 100, the drive unit 90 drives the motor 30 in the forward rotation mode. When receiving a reverse rotation driving signal SMQ from the control unit 100, the drive unit 90 drives the motor 30 in the reverse rotation mode. When receiving a rotation stop signal SMS from the control unit 100, the drive unit 90 stops supplying electric power to the motor 30.

The control unit 100 provides the drive unit 90 with a signal to control the motor 30 in accordance with the signals supplied from the detection unit 80. The control unit 100 calculates a rotation speed calculation value indicating the drive shaft rotation speed NM based on the rotation speed detection signal SN. The control unit 100 provides the drive unit 90 with the rotation driving signal SMD according to the trigger operation signal SS. The control unit 100 provides the drive unit 90 with the rotation stop signal SMS according to the load torque signal SL. The control unit 100 stops providing the rotation stop signal SMS according to the rotation speed detection signal SN. The control unit 100 provides the drive unit 90 with the forward rotation driving signal SMP according to the forward direction setting signal SP. The control unit 100 provides the drive unit 90 with the reverse rotation driving signal SMQ according to the reverse direction setting signal SQ.

FIG. 2 shows an example of the structure of the power transmission unit 40 and the clutch unit 50. The power transmission unit 40 sets the direction of the output shaft. The output shaft direction conforms to the axial direction of the tool drive shaft 32 or the tool output shaft 60.

The power transmission unit 40 includes the front-stage planet gear mechanism 41, the intermediate-stage planet gear mechanism 42, the rear-stage planet gear mechanism 43, a gear support 44, an intermediate component 45, a shaft restriction component 46, a radial bearing 47, a thrust bearing 48, and a cover 49.

The planet gear mechanisms 41 to 43 are arranged between the tool drive shaft 32 and the tool output shaft 60 in the output shaft direction. The front-stage planet gear mechanism 41, the intermediate-stage planet gear mechanism 42, and the rear-stage planet gear mechanism 43 are arranged in this order in the output shaft direction from the motor 30 toward the tool output shaft 60.

The front-stage planet gear mechanism 41 includes one front-stage sun gear 41A, three front-stage planet gears 41B, one front-stage annular gears 41C, and one front-stage carrier 41D. The front-stage planet gear mechanism 41 decelerates the rotation of the tool drive shaft 32, and transmits the decelerated rotation to the intermediate-stage planet gear mechanism 42.

The front-stage sun gear 41A is fixed to the tool drive shaft 32. The three front-stage planet gears 41B engage with the front-stage sun gear 41A and the front-stage annular gears 41C. The front-stage annular gears 41C are fixed to the housing 20. The front-stage carrier 41D has pins inserted into holes of the front-stage planet gears 41B.

The intermediate-stage planet gear mechanism 42 includes one intermediate-stage sun gear 42A, three intermediate-stage planet gears 42B, one intermediate-stage annular gear 42C, and one intermediate-stage carrier 42D. The intermediate-stage planet gear mechanism 42 decelerates the rotation of the front-stage planet gear mechanism 41, and transmits the decelerated rotation to the rear-stage planet gear mechanism 43.

The intermediate-stage sun gear 42A is integrated with the front-stage carrier 41D. The three intermediate-stage planet gears 42B engage with the intermediate-stage sun gear 42A and the intermediate-stage annular gear 42C. The intermediate-stage annular gear 42C is integrated with the front-stage annular gears 41C. The intermediate-stage carrier 42D has pins inserted into holes of the intermediate-stage planet gears 42B.

The rear-stage planet gear mechanism 43 includes one rear-stage sun gear 43A, three rear-stage planet gears 43B, one rear-stage annular gear 43C, and one rear-stage carrier 43D. The rear-stage planet gear mechanism 43 decelerates the rotation of the intermediate-stage planet gear mechanism 42, and transmits the decelerated rotation to the tool output shaft 60.

The rear-stage sun gear 43A is integrated with the intermediate-stage carrier 42D. The three rear-stage planet gears 43B engage with the rear-stage sun gear 43A and the rear-stage annular gear 43C. The rear-stage carrier 43D has pins inserted into holes of the rear-stage planet gears 43B.

The rear-stage annular gear 43C is pressed onto a support component 44A of the gear support 44 by the load input component 53 of the clutch unit 50. A frictional force produced between the rear-stage annular gear 43C and the support component 44A (hereinafter referred to as "rotation-restricting frictional force") acts as a rotational resistance of the rear-stage annular gear 43C against the housing 20. When the load torque TL is less than the disconnection torque TX and the rear-stage planet gears 43B rotates, the rear-stage annular gear 43C does not rotate relative to the support component 44A and the housing 20. When the load torque TL is greater than or equal to the disconnection torque TX, the rear-stage annular gear 43C is rotated relative to the support component 44A and the housing 20 by the torque transmitted from the rear-stage planet gears 43B. That is, the rotational motion of the rear-stage annular gear 43C relative to the support component 44A and the housing 20 varies in accordance with the relationship between the rotation-restricting frictional force and the load torque TL. In the following description, the rotation of the rear-stage annular gear 43C relative to the support component 44A and the housing 20 is referred to as "rotation of the rear-stage annular gear 43C relative to the housing 20" or a similar phrase.

The gear support 44 includes a support component 44A and a fixing component 44B. The support component 44A supports the rear-stage annular gear 43C in the output shaft direction. The fixing component 44B is fixed to the housing 20. The fixing component 44B supports the support component 44A in the output shaft direction.

The intermediate component 45 is fixed to the tool output shaft 60. The intermediate component 45 has a plurality of holes. Pins of the rear-stage carrier 43D are inserted into the holes of the intermediate component 45. The intermediate component 45 rotates integrally with the rear-stage carrier 43D and the tool output shaft 60.

As an example, the shaft restriction component 46 takes the form of a C-type snap ring. The shaft restriction component 46 is fixed to the housing 20. The shaft restriction component 46 is fitted into a groove of the tool output shaft 60. The shaft restriction component 46 restricts the tool output shaft 60 from moving relative to the housing 20 in the output shaft direction.

As an example, the radial bearing 47 takes the form of a metal sliding bearing. The radial bearing 47 is fixed to the housing 20. The radial bearing 47 receives the radial load of the tool output shaft 60.

As an example, the thrust bearing 48 takes the form of a thrust ball bearing. The thrust bearing 48 is fixed to the housing 20. The thrust bearing 48 receives the thrust load of the tool output shaft 60.

The cover 49 is fixed to the housing 20. The cover 49 covers an opening of the housing 20 opposed to the motor 30. The cover 49 has a hole through which the tool drive shaft 32 extends.

The clutch unit 50 includes the detection component 51, an clicking component 52, the load input component 53, a plurality of balls 54, the load adjustment section 55, and the rear-stage annular gear 43C. The clutch unit 50 changes the connection state between the rear-stage annular gear 43C and the support component 44A according to the load torque TL, thereby changing the transmission state of the torque from the rear-stage planet gears 43B to the rear-stage carrier 43D. In other words, the clutch unit 50 changes the connection state between the rear-stage annular gear 43C and the support component 44A according to the load torque TL, thereby connecting or disconnecting the torque transmission line between the tool drive shaft 32 and the tool output shaft 60.

For example the detection component 51 is shaped like a thin plate. The detection component 51 is in contact with the balls 54. The detection component 51 is pressed onto the balls 54 by a load from the load input component 53. The detection component 51 can move relative to the housing 20 and the rear-stage annular gear 43C in the output shaft direction. The position of the detection component 51 in the output shaft direction will hereinafter be referred to as "detection component position". The detection component position changes relative to the rear-stage annular gear 43C in a range of a reference position to an upper limit position.

The distance between the detection component 51 and the rear-stage annular gear 43C becomes minimal at the reference position, and becomes maximal at the upper limit position. The movement of the detection component 51 relative to the rear-stage annular gear 43C is in accordance with the detection component position. The movement of the detection component 51 will hereinafter be referred to as detection component movement amount L, the detection component movement amount L at the reference position will hereinafter be referred to as reference movement amount LL, and the detection component movement amount L at the upper limit position will hereinafter be referred to as upper limit movement LH.

The clicking component 52 is fixed to a handle 55A of the load adjustment section 55. The clicking component 52 can rotate relative to the housing 20 and the detection component 51. The clicking component 52 has a plurality of holes. A protrusion of the detection component 51 is inserted into and removed from the holes.

When the clicking component 52 rotates relative to the detection component 51, a situation in which the protrusion of the detection component 51 is inserted into a hole of the clicking component 52 and a situation in which the protrusion of the detection component 51 is removed from a hole of the clicking component 52 are alternately repeated. Thus, the clicking component 52 produces a clicking feel perceived by the person operating the handle 55A.

The load input component 53 is arranged between the load adjustment section 55 and the detection component 51 in the output shaft direction. For example, the load input component 53 takes the form of a coil spring. The load input component 53 is compressed between the load adjustment section 55 and the clicking component 52.

A restoring force of the load input component 53 will hereinafter be referred to as input load F. The input load F acts as a force pushing the detection component 51 and the clicking component 52 toward the balls 54. The input load F acts on the rear-stage annular gear 43C through the clicking component 52, the detection component 51, and the balls 54. In this manner, the input load F changes the level of the rotation-restricting frictional force.

Figure 3:
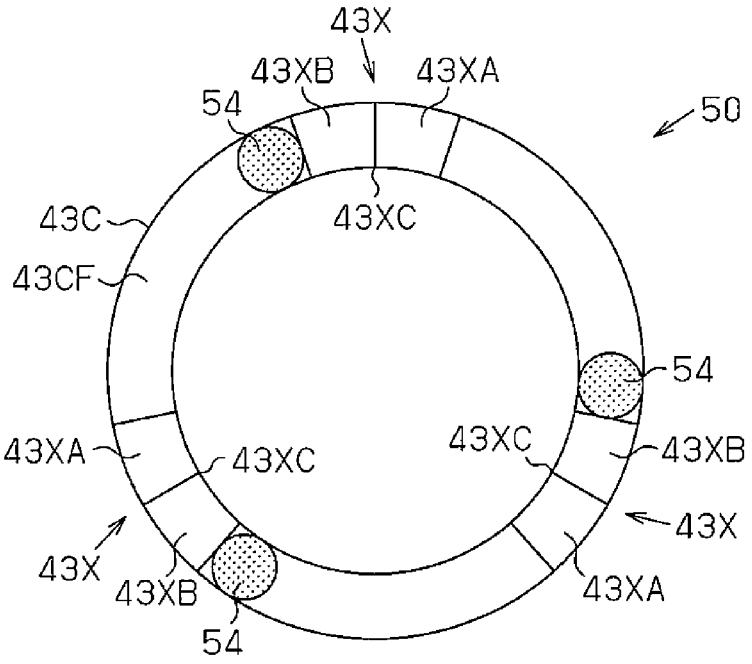
FIG. 3 is a plan view of a rear-stage annular gear and balls in the first embodiment.

The balls 54 are divided into three groups (see FIG. 3). Each group includes two balls 54. The two balls 54 in one group are accommodated in the single accommodation portion 21 and arranged in the output shaft direction. The two balls 54 can move relative to the housing 20 in the output shaft direction. One of the two balls 54 is in contact with the rear-stage annular gear 43C and the other one is in contact with the detection component 51.

The load adjustment section 55 includes the handle 55A and a rotational component 55B that are connected to each other. The load adjustment section 55 rotates relative to the housing 20, thereby changing a compressive deformation amount of the load input component 53. That is, the compressive deformation amount changes in accordance with the rotation amount of the load adjustment section 55.

The handle 55A has an inner void that accommodates the detection component 51, the clicking component 52, the load input component 53, the rotational component 55B, and part of the housing 20. The handle 55A can rotate relative to the housing 20. The handle 55A is used to adjust the compressive deformation amount of the load input component 53.

The rotational component 55B has a female screw. The female screw of the rotational component 55B engages with the threaded portion 22 formed in the housing 20. The rotational component 55B rotates relative to the housing 20 integrally with the handle 55A.

FIG. 3 shows the structure of components in the clutch unit 50 from above.

The rear-stage annular gear 43C includes an annular gear plane 43CF and three projections 43X. The annular gear plane 43CF defines an end surface opposed to the detection component 51. The projections 43X protrude from the annular gear plane 43CF toward the detection component 51. The projections 43X are arranged at equal intervals in the circumferential direction. The rear-stage annular gear 43C rotates relative to the housing 20 and the balls 54, thereby changing the position of each projection 43X relative to the balls 54.

Figure 4:
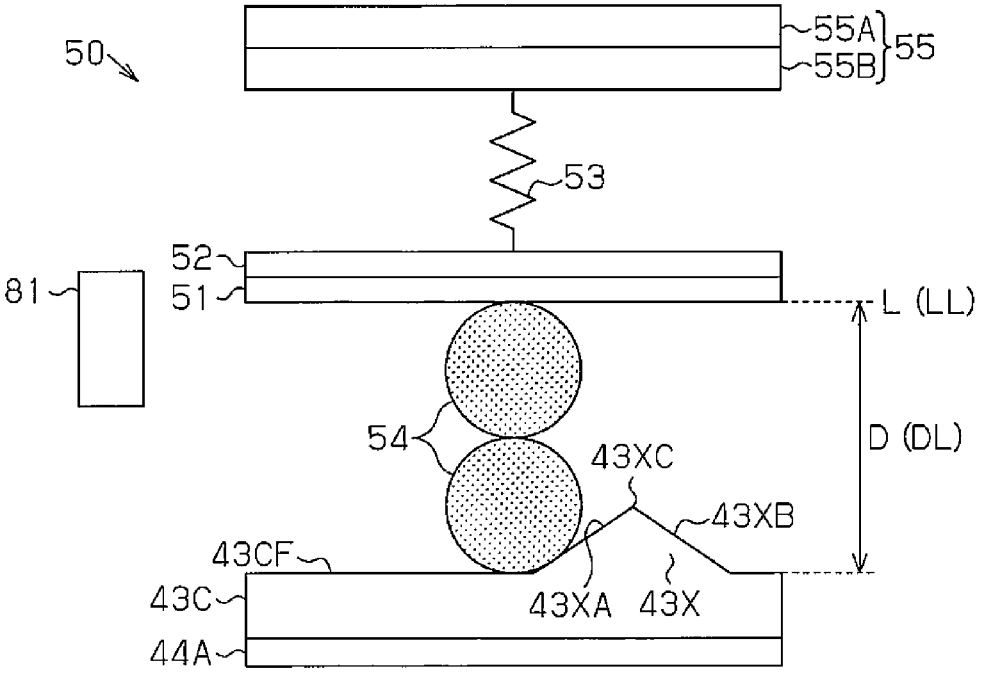
FIG. 4 is a model diagram of a clutch unit in the first embodiment.

FIG. 4 is a model diagram of the clutch unit 50 and the components relating to the clutch unit 50. In FIG. 4, the components such as the rear-stage annular gear 43C is shown on a virtual plane. A direction in which the rear-stage annular gear 43C rotates relative to the housing 20 will hereinafter be referred to as circumferential forward, and a direction opposite to the direction in which the rear-stage annular gear 43C rotates relative to the housing 20 will hereinafter be referred to as circumferential rearward.

For example, the sides of the projections 43X are shaped as shown in FIG. 4. Each of the projections 43X includes a first inclined surface 43XA, a second inclined surface 43XB, and a top 43XC. When the rear-stage annular gear 43C rotates, the projections 43X move the balls 54 in the output shaft direction.

The first inclined surface 43XA is formed from the boundary with one of the annular gear planes 43CF, adjacent to the projection 43X, to the top 43XC. When the tool drive shaft 32 rotates in the forward direction, the first inclined surface 43XA is present on the circumferential forward side of the top 43XC.

The second inclined surface 43XB is formed from the boundary with the other annular gear plane 43CF, adjacent to the projection 43X, to the top 43XC. When the tool drive shaft 32 rotates in the forward direction, the second inclined surface 43XB is present on the circumferential rearward side of the top 43XC.

The height of the projection 43X is defined by the distance between the annular gear plane 43CF and the surface of the projection 43X in the output shaft direction, and becomes maximal at the top 43XC.

When the rear-stage annular gear 43C rotates relative to the housing 20, the positions of the projections 43X relative to the balls 54 change. When the ball 54 contacts the projection 43X, the projection 43X presses the balls 54 toward the detection component 51. A force acting from the projection 43X onto the balls 54 is transmitted to the load input component 53 via the detection component 51 and the clicking component 52.

The load input component 53 changes the compressive deformation amount in accordance with the force acting from the projection 43X onto the balls 54. When the force acting on the balls 54 increases, the load input component 53 increases the compressive deformation amount. The balls 54, the detection component 51, and the clicking component 52 are moved away from the rear-stage annular gear 43C while compressively deforming the load input component 53.

When the balls 54 are separated from the annular gear plane 43CF, the balls 54 are located on the projection 43X. The balls 54 move from the annular gear plane 43CF to the projection 43X and then pass by the top 43XC and move to the annular gear plane 43CF again.

The distance between the detection component 51 and the rear-stage annular gear 43C in the output shaft direction is referred to as the distance between components D. When the balls 54 are located on the annular gear plane 43CF, the distance between the components D is set by the two balls 54 aligned in the output shaft direction. The distance between components D changes in accordance with the detection component position. The distance between components D increases as the detection component position changes from the reference position to the upper limit position. The distance between components D when the detection component 51 is located at the reference position will hereinafter be referred to as the reference distance DL, and the distance between components D when the detection component 51 is located at the upper limit position will hereinafter be referred to as the upper limit distance DH.

The input load F changes in accordance with the detection component position. The input load F when the detection component 51 is located at the reference position will hereinafter be referred to as the reference load FL, and the input load F when the detection component 51 is located at the upper limit position will hereinafter be referred to as the maximum load FH. The reference load FL corresponds to a minimum value of the input load F, and the maximum load FH corresponds to a maximum value of the input load F. The reference load FL and the maximum load FH are in accordance with the compressive deformation amount of the load input component 53 at the reference position.

The load detector 81 outputs the load torque signal SL in accordance with the detection component position. When the detection component movement amount L is less than an output switching movement LX, the load detector 81 does not output the load torque signal SL. When the detection component 51 is moved from the reference position toward the upper limit position, and the detection component movement amount L increases to the output switching movement LX or greater, the load detector 81 outputs the load torque signal SL. When the detection component 51 is moved from the upper limit position toward the reference position and the detection component movement amount L falls below the output switching movement LX, the load detector 81 stops outputting of the load torque signal SL.

The detection component position changes in accordance with the rotation of the rear-stage annular gear 43C relative to the housing 20. The rear-stage annular gear 43C rotates relative to the housing 20 according to the load torque TL. Thus, the load detector 81 indirectly detects the load torque TL based on the detection component movement amount L, and outputs the load torque signal SL according to the detection result.

FIGS. 4 to 8 show a series of sequences in which the detection component position changes from the reference position to the upper limit position and then returns again from the upper limit position to the reference position as the rear-stage annular gear 43C rotates relative to the housing 20.

FIG. 4 shows a situation in which the balls 54 do not run on the projection 43X. The detection component position is the reference position, the detection component movement amount L is the reference movement amount LL, the distance between components D is the reference distance DL, and the input load F is the reference load FL. Since the detection component movement amount L is less than the output switching movement LX, the load detector 81 does not output the load torque signal SL. When the rear-stage annular gear 43C rotates from the position shown in FIG. 4, the projection 43X moves the balls 54 away from the annular gear plane 43CF.

Figure 5:
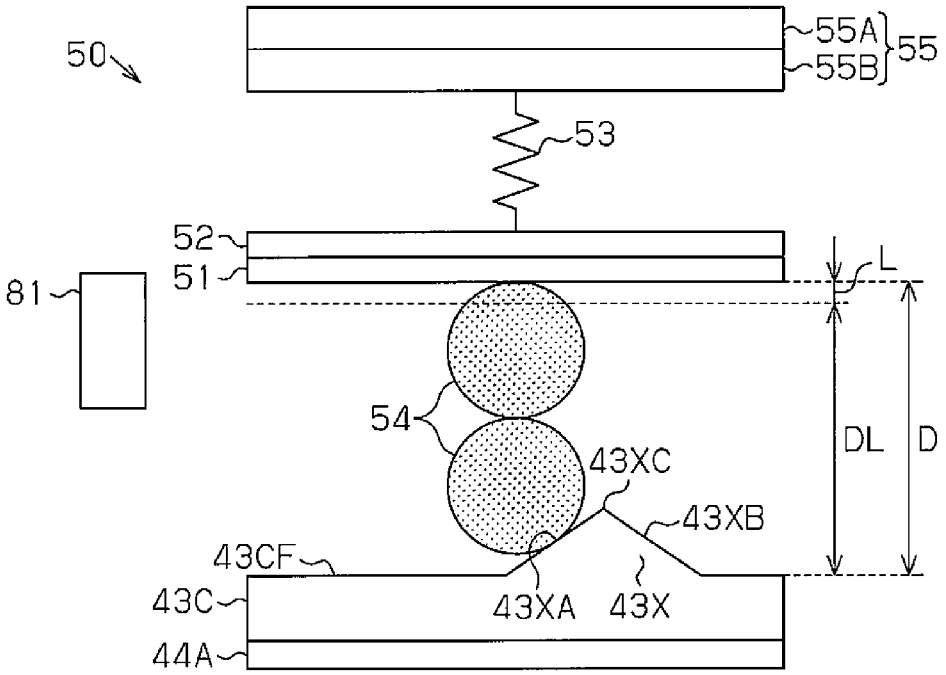
FIG. 5 is a model diagram of the clutch unit in the first embodiment.

FIG. 5 shows a situation in which the balls 54 run on the first inclined surface 43XA. The detection component position is located between the reference position and the upper limit position. The detection component movement amount L has a value between the reference movement amount LL and the upper limit movement LH. The distance between components D has a value between the reference distance DL and the upper limit distance DH. The input load F has a value between the reference load FL and the maximum load FH. When the detection component movement amount L increases to the output switching movement LX or greater, the load detector 81 outputs the load torque signal SL. When the rear-stage annular gear 43C rotates from the position shown in FIG. 5, the projection 43X further moves the balls 54 away from the annular gear plane 43CF.

Figure 6:
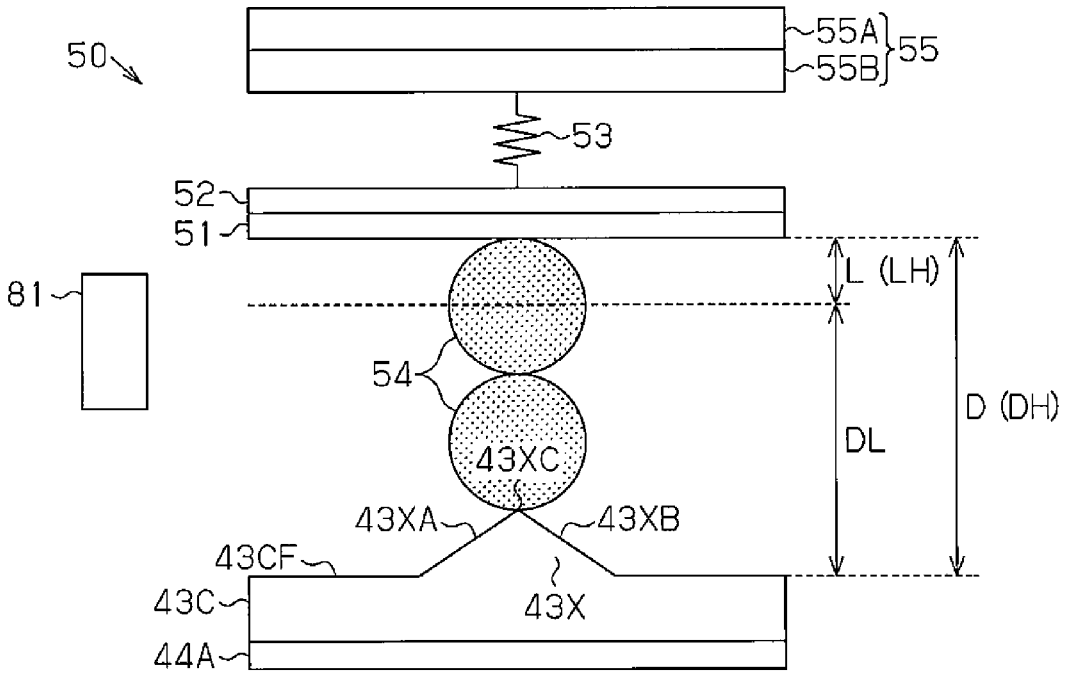
FIG. 6 is a model diagram of the clutch unit in the first embodiment.

FIG. 6 shows a situation in which the balls 54 run on the top 43XC. The detection component position is the upper limit position, the detection component movement amount L is the upper limit movement LH, the distance between components D is the upper limit distance DH, and the input load F is the maximum load FH. Since the detection component movement amount L is greater than or equal to the output switching movement LX, the load detector 81 outputs the load torque signal SL. When the rear-stage annular gear 43C rotates from the position shown in FIG. 6, the projection 43X moves the balls 54 closer to the annular gear plane 43CF.

Figure 7:
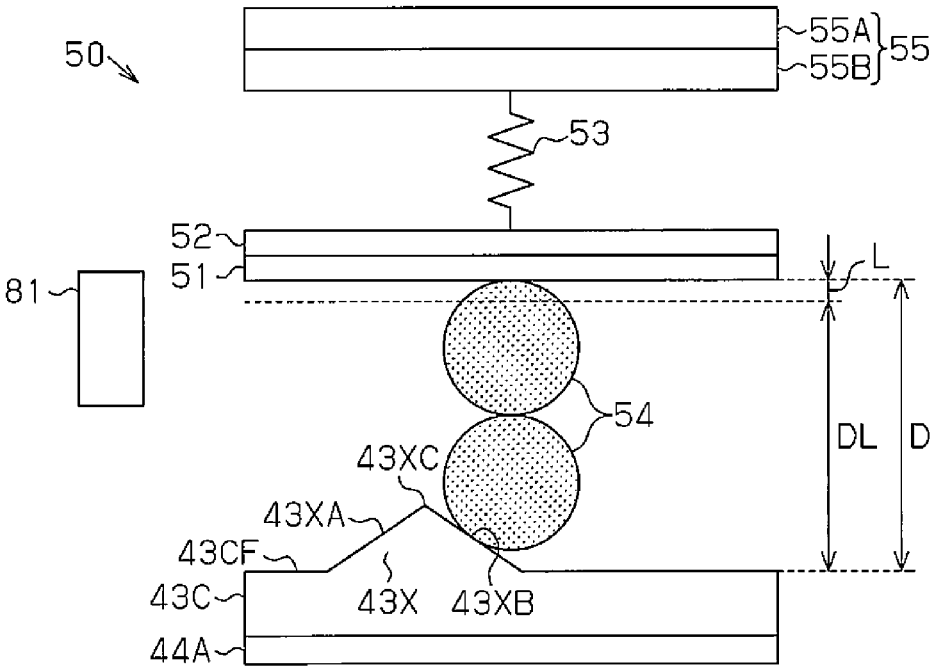
FIG. 7 is a model diagram of the clutch unit in the first embodiment.

FIG. 7 shows a situation in which the balls 54 run on the second inclined surface 43XB. The detection component position is located between the reference position and the upper limit position. The detection component movement amount L has a value between the reference movement amount LL and the upper limit movement LH. The distance between components D has a value between the reference distance DL and the upper limit distance DH. The input load F has a value between the reference load FL and the maximum load FH. When the detection component movement amount L falls below the output switching movement LX, the load detector 81 stops outputting the load torque signal SL. When the rear-stage annular gear 43C rotates from the position shown in FIG. 7, the projection 43X further moves the balls 54 closer to the annular gear plane 43CF.

Figure 8:
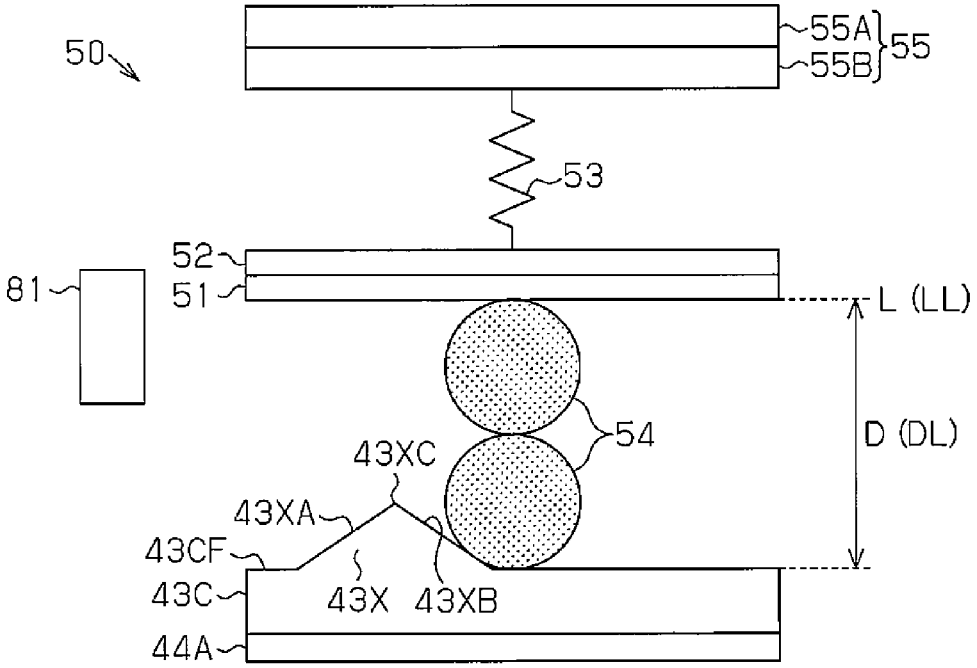
FIG. 8 is a model diagram of the clutch unit in the first embodiment.

FIG. 8 shows a situation in which the balls 54 do not run on the projection 43X. The detection component position is the reference position, the detection component movement amount L is the reference movement amount LL, the distance between components D is the reference distance DL, and the input load F is the reference load FL. Since the detection component movement amount L is less than the output switching movement LX, the load detector 81 does not output the load torque signal SL. When the rear-stage annular gear 43C rotates from the position shown in FIG. 8, the balls 54 moves on the annular gear plane 43CF and are separated from the projection 43X.

The control unit 100 controls the stopping of the motor 30. In this embodiment, the control unit 100 controls the stopping of the motor 30 by using functional blocks formed by hardware.

The control for stopping the motor 30 has the technical significance described below. Only one of the technical significances of the control for stopping the motor 30 is described below, and there may be other significances of the control for stopping the motor 30.

When the load torque TL increases to the disconnection torque TX or greater, the rear-stage annular gear 43C rotates relative to the housing 20. That is, when the load torque TL increases to the disconnection torque TX or greater, the clutch unit 50 disconnects the torque transmission line between the tool drive shaft 32 and the tool output shaft 60. When the load torque TL increases to the disconnection torque TX or greater, basically, the clutch unit 50 does not transmit torque to the tool output shaft 60. The timing when the rear-stage annular gear 43C starts to rotate relative to the housing 20 will hereinafter be referred to as "output interruption starting timing".

After the output interruption starting timing, the load detector 81 outputs the load torque signal SL based on the movement of the detection component 51. The control unit 100 outputs the rotation stop signal SMS according to the load torque signal SL. The drive unit 90 stops supplying of current to the motor 30 according to the rotation stop signal SMS. After stopping the current supply, the motor 30 is shifted to an inertial rotation mode. The motor 30 rotates in the inertial rotation mode while reducing its speed and then completely stops rotation. The timing when the drive unit 90 stops the supply of the current to the motor 30 will hereinafter be referred to as "driving current interruption timing", and the timing when the motor 30 completely stops rotation after the driving current interruption timing will hereinafter be referred to as "rotation complete stopping timing". A period from the output interruption starting timing to the rotation complete stopping timing will hereinafter be referred to as "post-output interruption period".

In the post-output interruption period, the motor 30 is rotated by a predetermined rotational angle (hereinafter referred to as "post-output interruption rotation amount RV"). The post-output interruption rotation amount RV in the post-output interruption period varies due to at least three factors that will now be described.

The first factor is the interval between the output interruption starting timing and the driving current interruption timing. The post-output interruption rotation amount RV increases as the interval becomes longer between the output interruption starting timing and the driving current interruption timing. The second factor is the drive shaft rotation speed NM. The post-output interruption rotation amount RV increases as the drive shaft rotation speed NM increases. The third factor is the load torque TL. The post-output interruption rotation amount RV increases as the load torque TL decreases.

In the post-output interruption period, the projections 43X move the balls 54 and the detection component 51. The detection component 51 changes the compressive deformation amount of the load input component 53 according to the detection component movement amount L. When the detection component movement amount L is larger than the reference movement amount LL, the input load F is larger than the reference load FL. The rotation-restricting frictional force increases as the input load F increases. That is, the balls 54 run on the projection 43X in the post-output interruption period, thereby temporarily increasing the rotation-restricting frictional force.

When the load torque TL is greater than or equal to the disconnection torque TX, and the rotation-restricting frictional force corresponding to the reference load FL occurs, the rear-stage annular gear 43C rotates relative to the housing 20. When the rotation-restricting frictional force corresponding to the input load F that is larger than the reference load FL occurs, the rear-stage annular gear 43C does not rotate or hardly rotates relative to the housing 20.

In other words, when the balls 54 are located on the projection 43X to increase the rotation-restricting frictional force in the post-output interruption period, the rear-stage annular gear 43C does not rotate or hardly rotates relative to the housing 20. Thus, when the rotation-restricting frictional force increases, the rear-stage planet gears 43B input a torque to the rear-stage carrier 43D. Accordingly, the tool output shaft 60 inputs a torque to the working subject. Thus, the tightening torque TC changes to a torque that is larger than the disconnection torque TX. A torque input to the tool output shaft 60 due to the increase in the rotation-restricting frictional force in the post-output interruption period will hereinafter be referred to as post-interruption input torque TS. A tightening torque TC when the motor 30 completely stops rotation will hereinafter be referred to as final tightening torque TCZ.

The final tightening torque TCZ is set mainly in accordance with the disconnection torque TX and the post-interruption input torque TS. The final tightening torque TCZ sets the accuracy of the operation relating to the working subject. Accordingly, it is preferred that a variation in the final tightening torque TCZ in each working subject is small. That is, preferably, the final tightening torque TCZ of each working subject is within a suitable range.

To bring the final tightening torque TCZ in the suitable range, the inventors conducted tests to check the relationship between the usage condition of the electric power tool 1 and the final tightening torque TCZ.

Figure 9:
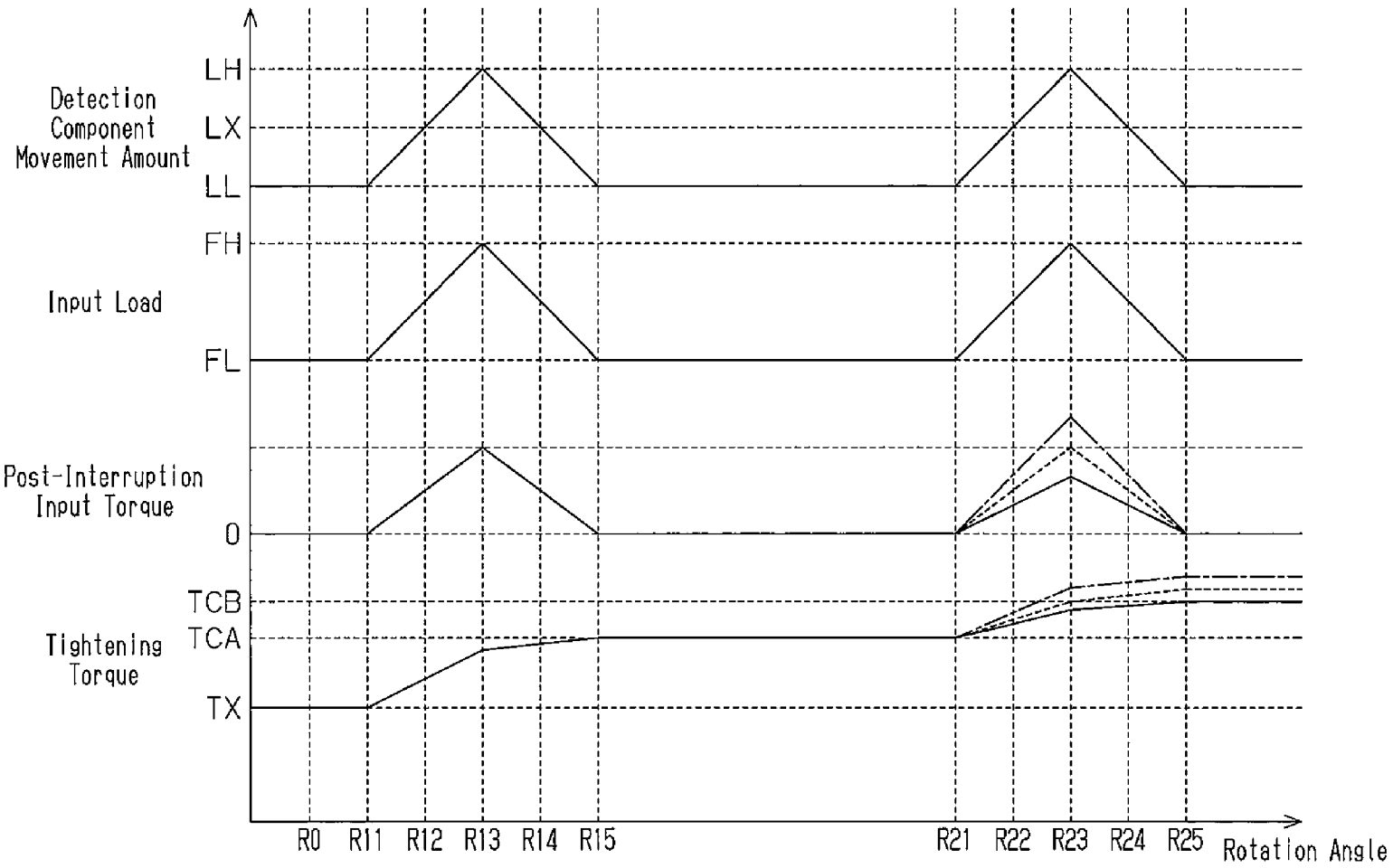
FIG. 9 is a timing chart of the operation of the electric power tool in the first embodiment.

FIG. 9 shows an example illustrating changes in each parameter confirmed in the tightening torque verification test. The X axis in FIG. 9 represents the rotational angle of the motor 30 and the rear-stage annular gear 43C in the post-output interruption period.

In the tightening torque verification test, two detection modes, that is, a rising detection mode and a falling detection mode were set as an output mode of the rotation stop signal SMS from the control unit 100. In the rising detection mode, the control unit 100 outputs the rotation stop signal SMS based on a rising of the load torque signal SL. In the falling detection mode, the control unit 100 outputs the rotation stop signal SMS based on a falling of the load torque signal SL.

The inventors conducted the first tightening torque verification test, the second tightening torque verification test, and the third tightening torque verification test under different conditions. In a first embodiment, the result of the first tightening torque verification test will be described. In a second embodiment, results of the second tightening torque verification test and the third tightening torque verification test will be described.

In the first tightening torque verification test, a high-speed driving usage condition and a low-speed driving usage condition are set as the usage condition of the electric power tool 1. In the high-speed driving usage condition, when the motor 30 runs at the drive shaft rotation speed NM that is a reference rotation speed NX or higher, the load torque TL reaches the disconnection torque TX. Under the low-speed driving usage condition, when the motor 30 runs at the drive shaft rotation speed NM that is less than the reference rotation speed NX, the load torque TL reaches the disconnection torque TX.

In the first tightening torque verification test, the relationship between the usage condition of the electric power tool 1 and the final tightening torque TCZ was checked according to the following first to fourth test patterns.

In the first test pattern, the rising detection mode and the high-speed driving usage condition were used. In the second test pattern, the rising detection mode and the low-speed driving usage condition were used. In the third test pattern, the falling detection mode and the high-speed driving usage condition were used. In the fourth test pattern, falling detection mode and the low-speed driving usage condition were used.

An example of the test result of the first test pattern will be described below.

A rotational angle R0 corresponds to the output interruption starting timing. At the rotational angle R0, the detection component movement amount L is the reference movement amount LL, the input load F is the reference load FL, the post-interruption input torque TS is "0" or substantial "0", and the tightening torque TC is the disconnection torque TX. The post-output interruption rotation amount RV corresponds to a change in the rotational angle after the rotational angle R0.

A rotational angle R11 represents a rotational angle immediately before the balls 54 start to run on the first projection 43X after the output interruption starting timing. At a rotational angle after the rotational angle R11, the detection component movement amount L increases in accordance with the movement of the balls 54, the input load F increases in accordance with the detection component movement amount L, the post-interruption input torque TS increases in accordance with the input load F, and the tightening torque TC increases in accordance with the post-interruption input torque TS.

A rotational angle R12 represents a rotational angle when the detection component movement amount L increases to the output switching movement LX or greater. At the rotational angle R12, the load torque signal SL rises. The control unit 100 selects the rising detection mode and thus, at the rotational angle R12, outputs the rotation stop signal SMS. That is, the rotational angle R12 corresponds to the driving current interruption timing.

A rotational angle R13 represents a rotational angle when the balls 54 run on the top 43XC. At the rotational angle R13, the detection component movement amount L is the upper limit movement LH, the input load F is the maximum load FH, and the post-interruption input torque TS is the maximum value. At a rotational angle after the rotational angle R13, the detection component movement amount L decreases in accordance with the movement of the balls 54, the input load F decreases in accordance with the detection component movement amount L, the post-interruption input torque TS decreases in accordance with the input load F, and the tightening torque TC increases in accordance with the post-interruption input torque TS.

A rotational angle R14 represents a rotational angle when the detection component movement amount L falls below the output switching movement LX. At the rotational angle R14, the load torque signal SL falls. The control unit 100 thus selects the rising detection mode and thus, at the rotational angle R14, does not change the output of the rotation stop signal SMS.

A rotational angle R15 represents a rotational angle immediately after the balls 54 run past the first projection 43X subsequent to the output interruption starting timing. At the rotational angle R15, the detection component movement amount L is the reference movement amount LL, the input load F is the reference load FL, the post-interruption input torque TS is "0" or substantial "0", tightening torque TC is a first post-running torque TCA that is larger than the disconnection torque TX.

A rotational angle R21 represents a rotational angle immediately before the balls 54 start to run on the second projection 43X after the output interruption starting timing. In a range of the rotational angle R15 to the rotational angle R21, the detection component movement amount L is the reference movement amount LL, the input load F is the reference load FL, the post-interruption input torque TS is "0" or substantial "0", and the tightening torque TC is the first post-running torque TCA.

In the range of the rotational angle R15 to the rotational angle R21, the motor 30 and the rear-stage annular gear 43C completely stop rotation. Thus, the final tightening torque TCZ is the first post-running torque TCA. A rotational angle when rotation of the motor 30 and the rear-stage annular gear 43C completely stops will hereinafter be referred to as "complete stop rotational angle". The complete stop rotational angle is represented as an angle relative to the rotational angle of the motor 30 or the rear-stage annular gear 43C at the output interruption starting timing.

According to the first test pattern, even when the complete stop rotational angle is any rotational angle in the range of the rotational angle R15 to the rotational angle R21, the final tightening torque TCZ is the first post-running torque TCA. Therefore, according to the first test pattern, variations are limited in the final tightening torque TCZ with respect to changes in the complete stop rotational angle.

An example of the test result of the second test pattern will be described below.

In a range of the rotational angle R12 to a rotational angle R13, the motor 30 and the rear-stage annular gear 43C completely stop rotation. Thus, the final tightening torque TCZ is the tightening torque TC between the disconnection torque TX and the first post-running torque TCA.

According to the second test pattern, when the complete stop rotational angle is in the range of the rotational angle R12 to the rotational angle R13, the final tightening torque TCZ changes in accordance with the complete stop rotational angle. Thus, according to the second test pattern, variations in the final tightening torque TCZ tend to occur in accordance with changes in the complete stop rotational angle.

The complete stop rotational angle of the first test pattern differs from the complete stop rotational angle of the second test pattern as described above. The differences between the complete stop rotational angles of the first and second test patterns results in difference between positions where the balls 54 run past the projection 43X after the driving current is interrupted. The reason for the difference between the complete stop rotational angles of the test patterns is as follows.

The operation of the motor 30 is delayed from the timing when the control unit 100 outputs a command signal. Thus, a timing when the motor 30 is shifted to the inertial rotation mode according to the rotation stop signal SMS (hereinafter referred to as "stop operation start timing") is delayed from the timing when the rotation stop signal SMS is output.

A rotation amount of the motor 30 after the driving current interruption timing will hereinafter be referred to as post-current interruption rotation amount RI. The post-current interruption rotation amount RI varies due to at least following two factors. The first factor is the drive shaft rotation speed NM. The post-current interruption rotation amount RI increases as the drive shaft rotation speed NM increases. The second factor is the load torque TL. The post-current interruption rotation amount RI increases as the load torque TL decreases.

According to the first test pattern, the drive shaft rotation speed NM is greater than or equal to the reference rotation speed NX. Accordingly, as compared to when the drive shaft rotation speed NM is less than the reference rotation speed NX, the post-current interruption rotation amount RI is larger. That is, when the drive shaft rotation speed NM is high, in a period when the stop operation start timing is delayed from the output timing of the rotation stop signal SMS, the rotation amount of the motor 30 is large. Thus, the motor 30 and the rear-stage annular gear 43C stop their rotation after the balls 54 run past the first projection 43X.

According to the second test pattern, the drive shaft rotation speed NM is less than the reference rotation speed NX. Accordingly, as compared to the first test pattern, the post-current interruption rotation amount RI is small. That is, when the drive shaft rotation speed NM is low, in the period when the stop operation start timing is delayed from the output timing of the rotation stop signal SMS, the rotation amount of the motor 30 is small. Thus, the motor 30 and the rear-stage annular gear 43C stop rotation when the balls 54 run on the first projection 43X.

An example of the test result of the third test pattern will now be described.

The rotational angle R12 represents a rotational angle when the detection component movement amount L increases to the output switching movement LX or greater. At the rotational angle R12, the load torque signal SL rises. The control unit 100 selects the falling detection mode and, thus, at the rotational angle R12, does not change the output of the rotation stop signal SMS.

A rotational angle R14 represents a rotational angle when the detection component movement amount L falls below the output switching movement LX. At the rotational angle R14, the load torque signal SL falls. The control unit 100 selects the falling detection mode and, thus, at the rotational angle R14, outputs the rotation stop signal SMS. That is, the rotational angle R14 corresponds to the driving current interruption timing.

In the range of the rotational angle R15 to the rotational angle R21, the motor 30 and the rear-stage annular gear 43C do not stop rotation. That is, the motor 30 continues to rotate in the inertial rotation mode even after reaching the rotational angle R21. The rear-stage annular gear 43C continues rotation as the motor 30 rotates.

The rotational angle R21 represents a rotational angle immediately before the balls 54 start to run on the second projection 43X after the output interruption starting timing. At a rotational angle after the rotational angle R21, the detection component movement amount L increases in accordance with the movement of the balls 54, the input load F increases in accordance with the detection component movement amount L, the post-interruption input torque TS increases in accordance with the input load F, and the tightening torque TC increases in accordance with the post-interruption input torque TS.

A rotational angle R22 represents a rotational angle when the detection component movement amount L increases to the output switching movement LX or greater. At the rotational angle R22, the load torque signal SL rises. The control unit 100 outputs the rotation stop signal SMS and thus, at the rotational angle R22, does not change the output of the rotation stop signal SMS.

A rotational angle R23 represents a rotational angle when the balls 54 run on the top 43XC. At the rotational angle R23, the detection component movement amount L is the upper limit movement LH, the input load F is the maximum load FH, and the post-interruption input torque TS has the maximum value. At a rotational angle after the rotational angle R23, the detection component movement amount L decreases in accordance with the movement of the balls 54, the input load F decreases in accordance with the detection component movement amount L, the post-interruption input torque TS decreases in accordance with the input load F, and the tightening torque TC increases in accordance with the post-interruption input torque TS.

A rotational angle R24 represents a rotational angle when the detection component movement amount L falls below the output switching movement LX. At the rotational angle R24, the load torque signal SL falls. The control unit 100 selects the rising detection mode and thus, at the rotational angle R24, does not change the output of the rotation stop signal SMS.

A rotational angle R25 represents a rotational angle immediately after the balls 54 run past the second projection 43X after the output interruption starting timing. At the rotational angle R25, the detection component movement amount L is the reference movement amount LL, the input load F is the reference load FL, the post-interruption input torque TS is "0" or substantial "0", and the tightening torque TC is a second post-running torque TCB that is larger than the first post-running torque TCA.

The motor 30 and the rear-stage annular gear 43C completely stop rotation in the range from the rotational angle R25 until immediately before the third projections 43X. Thus, the final tightening torque TCZ represents the second post-running torque TCB. When the drive shaft rotation speed NM is higher than the high-speed driving usage condition, the motor 30 and the rear-stage annular gear 43C stop at the rotational angle at which the balls 54 run on or over the third projections 43X. The drive shaft rotation speed NM that is higher than the high-speed driving usage condition can be defined as a high-speed reference rotation speed NXH that is larger than the reference rotation speed NX. That is, the drive shaft rotation speed NM that is larger than the high-speed reference rotation speed NXH represents the drive shaft rotation speed NM that is higher than the high-speed driving usage condition.

The inventors confirmed that the post-interruption input torque TS changes in various manners when the balls 54 run past the second projection 43X. For example, the post-interruption input torque TS changes as indicated by solid lines, broken lines, and single-dashed lines in FIG. 9.

When the post-interruption input torque TS changes as indicated by the solid line, the torque TS when the balls 54 run on the second projection 43X becomes smaller than the torque TS when the balls 54 run on the first projection 43X.

When the post-interruption input torque TS changes as indicated by the broken line, the torque TS when the balls 54 run on the first projection 43X becomes equal to the torque TS when the balls 54 run on the second projection 43X.

When the post-interruption input torque TS changes as indicated by the single-dashed line, the torque TS when the balls 54 run on the second projection 43X becomes larger than the torque TS when the balls 54 run on the first projection 43X.

Another example of the test result of the third test pattern will be described below.

In the range of the rotational angle R21 to the rotational angle R23, the motor 30 and the rear-stage annular gear 43C completely stop their rotation. In this case, the final tightening torque TCZ has a value between the first post-running torque TCA and the second post-running torque TCB.

The complete stop rotational angle according to the third test pattern may be the rotational angle in the range from the rotational angle R25 until immediately before the third projection 43X, or in the range of the rotational angle R21 to the rotational angle R23.

The final tightening torque TCZ according to the third test pattern varies for at least the two following reasons. The first reason is that the change of the post-interruption input torque TS in the process when the balls 54 run past the second projection 43X. The second reason is the complete stop rotational angle. That is, in the third test pattern, variations in the final tightening torque TCZ tend to occur in accordance with changes in the complete stop rotational angle.

An example of the test result of the fourth test pattern will be described below.

The rotational angle R12 represents the rotational angle when the detection component movement amount L increases to the output switching movement LX or greater. At the rotational angle R12, the load torque signal SL rises. The control unit 100 selects the falling detection mode and thus, at the rotational angle R12, does not output the rotation stop signal SMS.

The rotational angle R14 represents the rotational angle when the detection component movement amount L falls below the output switching movement LX. At the rotational angle R14, the load torque signal SL falls. The control unit 100 selects the falling detection mode and thus, at the rotational angle R14, outputs the rotation stop signal SMS.

In the range of the rotational angle R15 to the rotational angle R21, the motor 30 and the rear-stage annular gear 43C completely stop rotation. In this case, the final tightening torque TCZ is the first post-running torque TCA.

In the fourth test pattern, regardless of the rotational angle, when the complete stop rotational angle is in the range of the rotational angle R15 to the rotational angle R21, the final tightening torque TCZ is the first post-running torque TCA. Therefore, in the fourth test pattern, variations in the final tightening torque TCZ are limited when changes occur in the complete stop rotational angle.

The complete stop rotational angle in the third test pattern differs from the complete stop rotational angle in the fourth test pattern as described above. The difference between the complete stop rotational angles according to the third and fourth test patterns causes a difference between positions where the balls 54 run past the projection 43X after the driving current is interrupted. The reason for the difference between the complete stop rotational angles in the test patterns is as follows.

In the third test pattern, the control unit 100 outputs the rotation stop signal SMS in the falling detection mode. Thus, as compared to the first test pattern, the rotational resistance of the motor 30 and the rear-stage annular gear 43C in an initial stage after the driving current interruption timing is smaller. In addition, according to the third test pattern, the drive shaft rotation speed NM is greater than or equal to the reference rotation speed NX. Thus, as compared to when the drive shaft rotation speed NM is less than the reference rotation speed NX, the post-current interruption rotation amount RI is larger. Thus, the motor 30 and the rear-stage annular gear 43C stop rotation when the balls 54 run on the second projection 43X or after the balls 54 run past the second projection 43X.

In the fourth test pattern, the control unit 100 outputs the rotation stop signal SMS in the falling detection mode. Thus, as compared to the second test pattern, a rotational resistance of the motor 30 and the rear-stage annular gear 43C in an initial stage after the driving current interruption timing is smaller. According to the fourth test pattern, the drive shaft rotation speed NM is less than the reference rotation speed NX. Thus, as compared to the third test pattern, the post-current interruption rotation amount RI is smaller. Accordingly, the motor 30 and the rear-stage annular gear 43C stop rotation before the balls 54 run on the second projection 43X.

The inventors have made the following observations from the result of the first tightening torque verification test.

In the post-output interruption period, when the motor 30 and the rear-stage annular gear 43C completely stop rotation after the balls 54 run past the first projection 43X and before the balls 54 run on the second projection 43X, the variation in the final tightening torque TCZ is small.

In the post-output interruption period, when the motor 30 and the rear-stage annular gear 43C completely stop rotation as the balls 54 run on the first projection 43X, the variation in the final tightening torque TCZ is large.

In the post-output interruption period, when the motor 30 and the rear-stage annular gear 43C completely stop rotation after the balls 54 run past the second projection 43X and before the balls 54 run on the third projections 43X, the variation in the final tightening torque TCZ is large.

In the post-output interruption period, when the motor 30 and the rear-stage annular gear 43C completely stop rotation as the balls 54 run on the second projection 43X, the variation in the final tightening torque TCZ is large.

In the post-output interruption period, when the motor 30 and the rear-stage annular gear 43C completely stop rotation after the balls 54 run past the third or subsequent projection 43X and before the balls 54 run on the next projections 43X, the variation in the final tightening torque TCZ is large.

In the post-output interruption period, when the motor 30 and the rear-stage annular gear 43C completely stop their rotation when the balls 54 run on the third or subsequent projection 43X, the variation in the final tightening torque TCZ is large.

Therefore, in the first test pattern and the fourth test pattern, after the balls 54 run past the first projection 43X and before the balls 54 run on the second projection 43X, the motor 30 and the rear-stage annular gear 43C tend to stop rotation.

The control unit 100 operates in the control of stopping of the motor 30 as follows.

The control unit 100 compares the rotation speed calculation value NMC with a rotation speed calculation-value comparison signal SNX. The rotation speed calculation-value comparison signal SNX is previously set as a signal representing the reference rotation speed NX. When determining that the drive shaft rotation speed NM is greater than or equal to the reference rotation speed NX based on the comparison of the rotation speed calculation value NMC and the rotation speed calculation-value comparison signal SNX, the control unit 100 selects the rising detection mode.

For example, when the rotation speed calculation value NMC is greater than or equal to the rotation speed calculation-value comparison signal SNX (reference rotation speed NX), the control unit 100 determines that the drive shaft rotation speed NM is greater than or equal to the reference rotation speed NX.

When determining that the drive shaft rotation speed NM is less than the reference rotation speed NX based on the comparison of the rotation speed detection signal SN and the rotation speed calculation-value comparison signal SNX, the control unit 100 selects the falling detection mode.

For example, when the rotation speed calculation value NMC is less than the rotation speed calculation-value comparison signal SNX (reference rotation speed NX), the control unit 100 determines that the drive shaft rotation speed NM is less than the reference rotation speed NX.

Figure 10:
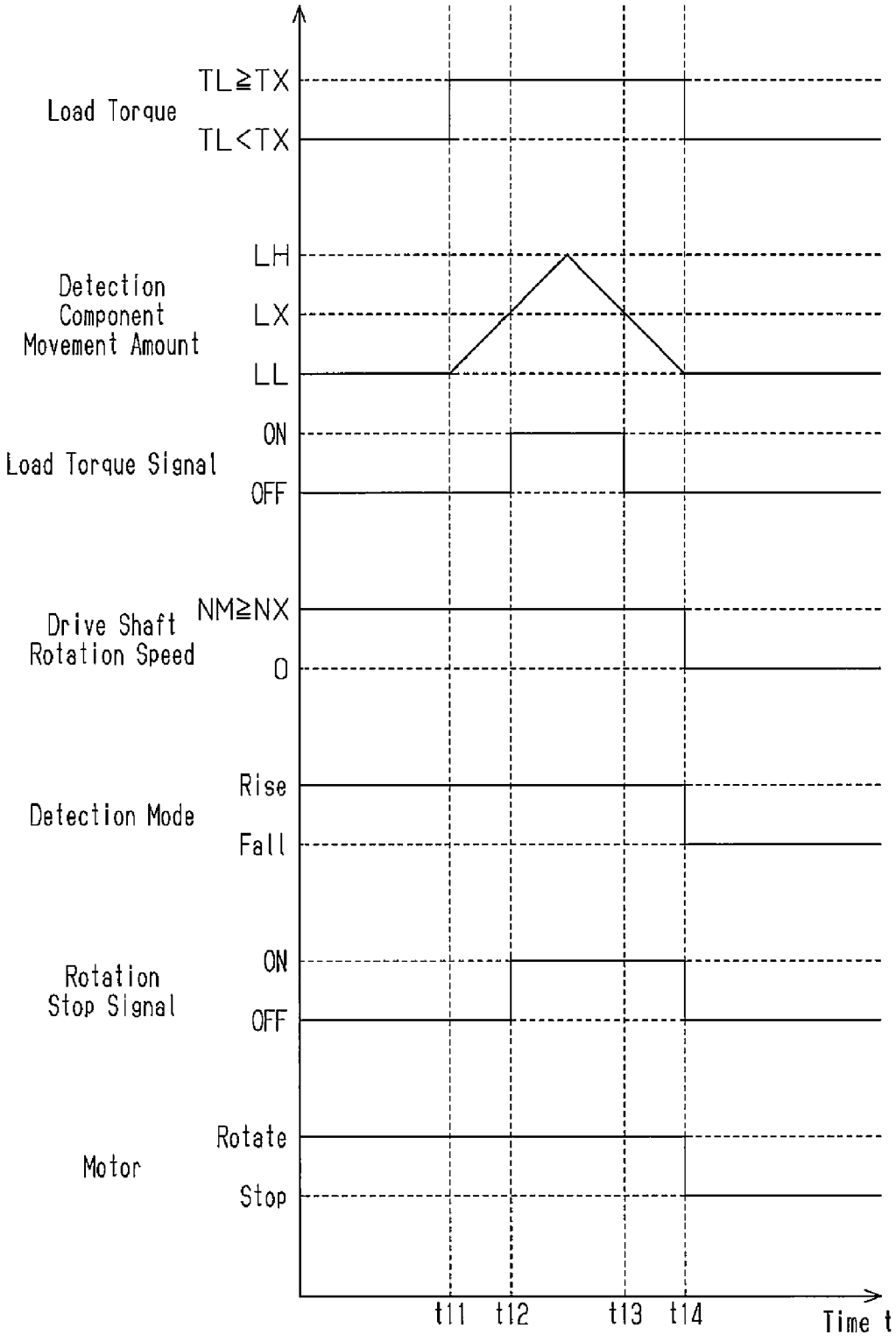
FIG. 10 is a timing chart of the operation of the electric power tool in the first embodiment.

FIG. 10 shows an example of the operation of the electric power tool 1. In the operational example, a driver serving as the bit 2 is connected to the electric power tool 1.

In a period immediately before time t11, the electric power tool 1 performs the following operation.

The trigger switch 71 is located at the maximum output position. The control unit 100 outputs the rotation driving signal SMD to the drive unit 90 according to the trigger operation signal SS. The drive unit 90 supplies current to the motor 30 according to the rotation driving signal SMD. The load torque TL is less than the disconnection torque TX. Thus, the rear-stage annular gear 43C does not rotate relative to the housing 20. Accordingly, the clutch unit 50 connects the torque transmission line between the tool drive shaft 32 and the tool output shaft 60.

The detection component 51 is located at the reference position. Thus, the load detector 81 does not output the load torque signal SL. Thus, the control unit 100 does not output the rotation stop signal SMS. The control unit 100 calculates the drive shaft rotation speed NM according to the rotation speed detection signal SN, and determines that the drive shaft rotation speed NM is greater than or equal to the reference rotation speed NX to select the rising detection mode.

At time t11, the electric power tool 1 performs the following operation.

The load torque TL increases to the disconnection torque TX or greater. Thus, the rear-stage annular gear 43C rotates relative to the housing 20, and the clutch unit 50 disconnects the torque transmission line between the tool drive shaft 32 and the tool output shaft 60. The projections 43X rotate relative to the balls 54, and the detection component 51 is moved relative to the rear-stage annular gear 43C. As a result, the detection component movement amount L starts to increase from the reference movement amount LL.

The detection component movement amount L has a value between the reference movement amount LL and the output switching movement LX. Since the load detector 81 does not output the load torque signal SL, the control unit 100 does not output the rotation stop signal SMS. Thus, the drive unit 90 continues to supply current to the motor 30 according to the rotation driving signal SMD.

In a period from time t11 until immediately before time t12, the electric power tool 1 performs the following operation.

The load torque TL is greater than or equal to the disconnection torque TX. The drive unit 90 supplies current to the motor 30. The rear-stage annular gear 43C rotates relative to the housing 20. The contact position of the projection 43X with the balls 54 changes according to the rotational angle of the rear-stage annular gear 43C. As a result, the detection component movement amount L increases.

At time t12, the electric power tool 1 performs the following operation.

The detection component movement amount L increases to the output switching movement LX or greater. Thus, the load detector 81 outputs the load torque signal SL to the control unit 100. At this time, the load torque signal SL rises.

The control unit 100 calculates the drive shaft rotation speed NM according to the rotation speed detection signal SN, and determines that the drive shaft rotation speed NM is greater than or equal to the reference rotation speed NX to select the rising detection mode. The control unit 100 outputs the rotation stop signal SMS to the drive unit 90 according to the rising of the load torque signal SL. Thus, the drive unit 90 stops supply of the current to the motor 30.

In a period from time t12 until immediately before time t13, the electric power tool 1 performs the following operation.

The motor 30 rotates in the inertial rotation mode. The rear-stage annular gear 43C rotates relative to the housing 20. The contact position of the projection 43X with the balls 54 changes with the change of the rotational angle of the rear-stage annular gear 43C. Thus, the detection component movement amount L increases to the upper limit movement LH and then gradually decreases.

At time t13, the electric power tool 1 performs the following operation.

The detection component movement amount L falls below the output switching movement LX. Thus, the load detector 81 stops outputting of the load torque signal SL. At this time, the load torque signal SL represents falling.

At time t14, the electric power tool 1 performs the following operation.

The motor 30 and the rear-stage annular gear 43C completely stop rotation. The load torque TL falls below the disconnection torque TX. The detection component movement amount L is the reference movement amount LL. The control unit 100 calculates the drive shaft rotation speed NM according to the rotation speed detection signal SN, and determines that the drive shaft rotation speed NM is less than the reference rotation speed NX to select the falling detection mode. The control unit 100 determines that the drive shaft rotation speed NM is "0" to stop the output of the rotation stop signal SMS.

The electric power tool 1 has the following advantages.

(1) The control unit 100 can execute the rising detection mode and the falling detection mode, and selects the rising detection mode or the falling detection mode based on the rotation speed detection signal SN that is the usage condition signal. Therefore, the detection mode is selected according to the usage condition of the electric power tool 1, and the stopping of the rotation of the motor 30 is controlled based on the selected detection mode. This can reduce the variation in the load torque TL (final tightening torque TCZ) when the motor 30 stops rotation.

(2) When the drive shaft rotation speed NM is greater than or equal to the reference rotation speed NX, the control unit 100 selects the rising detection mode. Thus, the motor 30 and the rear-stage annular gear 43C completely stop rotation after the balls 54 run past the first projection 43X and before the balls 54 run on the second projection 43X. Therefore, the variation in the final tightening torque TCZ becomes small.

(3) When the drive shaft rotation speed NM is less than the reference rotation speed NX, the control unit 100 selects the falling detection mode. Thus, the motor 30 and the rear-stage annular gear 43C completely stop rotation after the balls 54 run past the first projection 43X and before the balls 54 run on the second projection 43X. Therefore, the variation in the final tightening torque TCZ becomes small.

Second Embodiment

Figure 11:
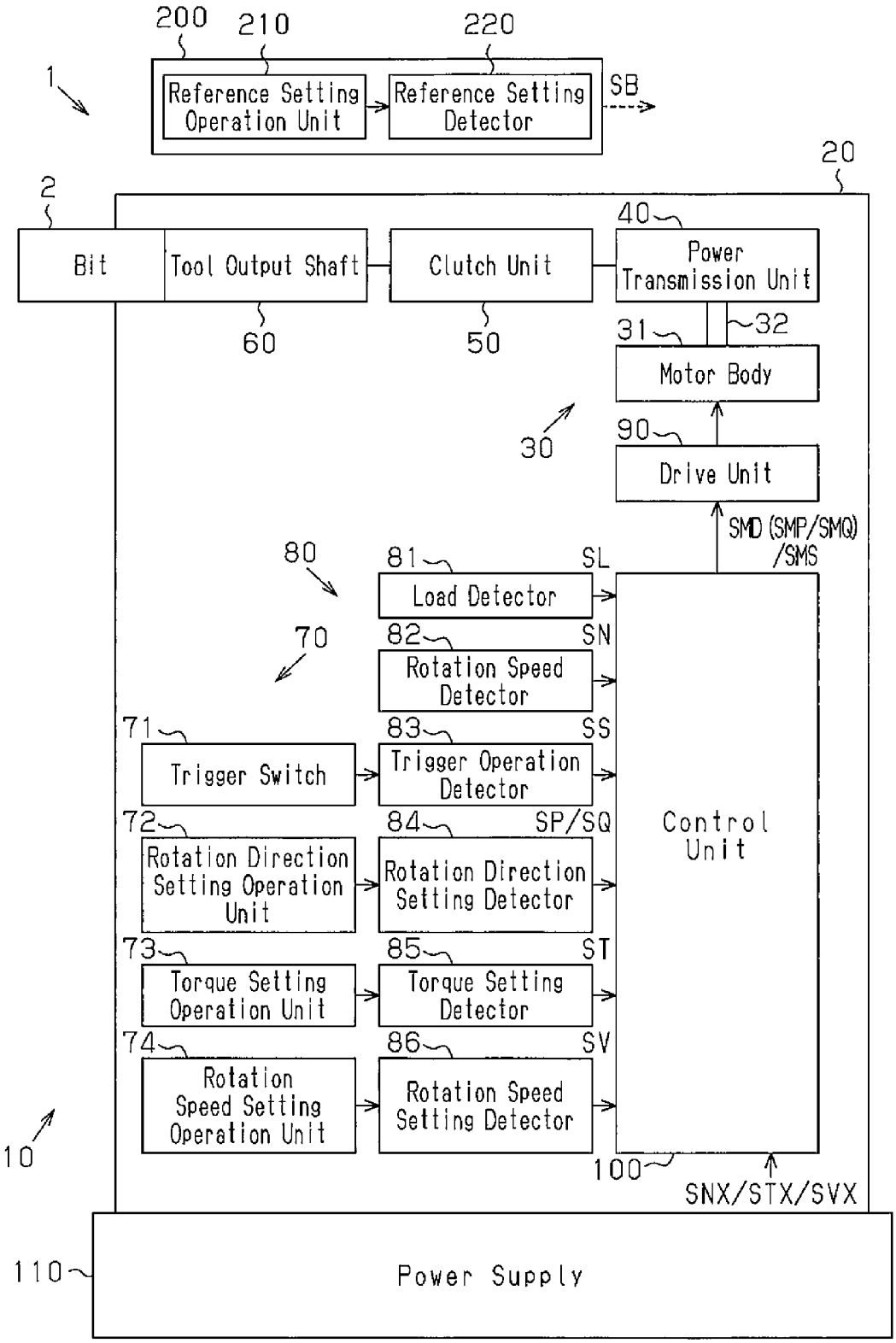
FIG. 11 is a block diagram of an electric power tool in a second embodiment.

FIG. 11 shows an electric power tool 1 in the second embodiment. Like or same reference numerals are given to those components that are the same as the corresponding components of the first embodiment. Such components will not be described in detail.

The electric power tool 1 in the second embodiment differs from the electric power tool 1 in the first embodiment mainly in the following points. The electric power tool 1 has a controller 200 in addition to the electric power tool body 10 and the power supply 110. The operation unit 70 includes a rotation speed setting operation unit 74 in addition to the trigger switch 71, the rotation direction setting operation unit 72, and the torque setting operation unit 73. The detection unit 80 includes a torque setting detector 85 and a rotation speed setting detector 86 in addition to the load detector 81, the rotation speed detector 82, the trigger operation detector 83, and the rotation direction setting detector 84. Each of the trigger switch 71, the rotation direction setting operation unit 72, the torque setting operation unit 73, and the rotation speed setting operation unit 74 is an example of the condition setting operation unit. Each of the load detector 81, the rotation speed detector 82, the trigger operation detector 83, the rotation direction setting detector 84, the torque setting detector 85, and the rotation speed setting detector 86 is an example of the condition setting detector. A signal output from each of the detectors 81 to 86 corresponds to a usage condition signal.

The rotation speed setting operation unit 74 takes the form of a human-machine interface. The rotation speed setting operation unit 74 is used to set a target value of the rotation speed of the tool drive shaft 32 (hereinafter referred to as "target rotation speed NV"). The user can operate the rotation speed setting operation unit 74 in steps within a range from a low-speed rotation position to a high-speed rotation position.

When the rotation speed setting operation unit 74 is set to the low-speed rotation position, the target rotation speed NV is set to a low-speed rotation speed NVL (minimum value). When the rotation speed setting operation unit 74 is set to the high-speed rotation position, the target rotation speed NV is set to a high-speed rotation speed NVH (maximum value).

The torque setting detector 85 detects the operation position of the torque setting operation unit 73. The torque setting detector 85 supplies a setting torque signal ST corresponding to the operation position of the torque setting operation unit 73 to the control unit 100.

The rotation speed setting detector 86 detects the operation position of the rotation speed setting operation unit 74. The rotation speed setting detector 86 supplies a target rotation speed signal SV corresponding to the operation position of the rotation speed setting operation unit 74 to the control unit 100.

The controller 200 takes the form of a portable device. The controller 200 includes a reference setting operation unit 210 and a reference setting detector 220. The controller 200 has a function for performing wireless communication with the electric power tool body 10.

The reference setting operation unit 210 takes the form of a human-machine interface. The reference setting operation unit 210 is used to change the reference rotation speed NX. The reference setting operation unit 210 includes a plurality of buttons.

The reference setting detector 220 detects a button operated by the reference setting operation unit 210. The reference setting detector 220 transmits a reference rotation speed signal SB corresponding to the operated button to the electric power tool body 10.

The control unit 100 feedback-controls the drive shaft rotation speed NM based on the target rotation speed signal SV and the rotation speed calculation value NMC. For example, when the low-speed rotation speed NVL is selected, the control unit 100 causes the drive shaft rotation speed NM to converge to the low-speed rotation speed NVL. When the high-speed rotation speed NVH is selected, the control unit 100 causes the drive shaft rotation speed NM to converge to the high-speed rotation speed NVH.

The inventors conducted a second tightening torque verification test. In the second tightening torque verification test, a low-load usage condition and a high-load usage condition were set as the usage condition of the electric power tool 1. Under the low-load usage condition, the disconnection torque TX was set to be less than the reference disconnection torque TXN. Under the high-load usage condition, the disconnection torque TX was set to be greater than or equal to the reference disconnection torque TXN.

In the second tightening torque verification test, the relationship between the usage condition of the electric power tool 1 and the final tightening torque TCZ was checked according to the following fifth to eighth test patterns.

In the fifth test pattern, the rising detection mode and the low-load usage condition were used. In the sixth test pattern, the rising detection mode and the high-load usage condition were used. In the seventh test pattern, the falling detection mode and the low-load usage condition were used. In the eighth test pattern, the falling detection mode and the high-load usage condition were used.

The test result of the fifth test pattern is similar to the test result of the first test pattern (the rising detection mode and the high-speed driving usage condition) in the first tightening torque verification test.

The test result of the sixth test pattern is similar to the test result of the second test pattern (the rising detection mode and the low-speed driving usage condition) in the first tightening torque verification test.

The test result of the seventh test pattern is similar to the test result of the third test pattern (the falling detection mode and the high-speed driving usage condition) in the first tightening torque verification test.

The test result of the eighth test pattern is similar to the test result of the fourth test pattern (the falling detection mode and the low-speed driving usage condition) in the first tightening torque verification test.

The control unit 100 controls the stopping of the motor 30 in the following manner.

The control unit 100 compares the setting torque signal ST with a setting torque comparison signal STX. When determining that the disconnection torque TX is less than the reference disconnection torque TXN based on the comparison of the setting torque signal ST and the setting torque comparison signal STX, the control unit 100 selects the rising detection mode.

For example, when the setting torque signal ST is less than the setting torque comparison signal STX, the control unit 100 determines that the disconnection torque TX is less than the reference disconnection torque TXN.

When determining that the disconnection torque TX is greater than or equal to the reference disconnection torque TXN based on the comparison of the setting torque signal ST and the setting torque comparison signal STX, the control unit 100 selects the falling detection mode.

For example, when the setting torque signal ST is greater than or equal to the setting torque comparison signal STX, the control unit 100 determines that the disconnection torque TX is greater than or equal to the reference disconnection torque TXN.

The inventors conducted the third tightening torque verification test. In the third tightening torque verification test, a high-speed setting usage condition and a low-speed setting usage condition were set as the usage condition of the electric power tool 1. Under the high-speed setting usage condition, the target rotation speed NV was set to be greater than or equal to the reference target rotation speed NVX. Under the low-speed setting usage condition, the target rotation speed NV was set to be less than the reference target rotation speed NVX.

In the third tightening torque verification test, the relationship between the usage condition of the electric power tool 1 and the final tightening torque TCZ was checked in the following ninth to twelfth test patterns.

In the ninth test pattern, the rising detection mode and the high-speed setting usage condition were used. In the tenth test pattern, the rising detection mode and the low-speed setting usage condition were used. In the eleventh test pattern, the falling detection mode and the high-speed setting usage condition were used. In the twelfth test pattern, the falling detection mode and the low-speed setting usage condition were used.

The test result of the ninth test pattern is similar to the test result of the first test pattern (the rising detection mode and the high-speed driving usage condition) in the first tightening torque verification test.

The test result of the tenth test pattern is similar to the test result of the second test pattern (the rising detection mode and the low-speed driving usage condition) in the first tightening torque verification test.

The test result of the eleventh test pattern is similar to the test result of the third test pattern (the falling detection mode and the high-speed driving usage condition) in the first tightening torque verification test.

The test result of the twelfth test pattern is similar to the test result of the fourth test pattern (the falling detection mode and the low-speed driving usage condition) in the first tightening torque verification test.

The control unit 100 controls the stopping of the motor 30 as follows.

The control unit 100 compares the target rotation speed signal SV with a target rotation speed comparison signal SVX. When determining that the target rotation speed NV is greater than or equal to the reference target rotation speed NVX based on the comparison of the target rotation speed signal SV and the target rotation speed comparison signal SVX, the control unit 100 selects the rising detection mode.

For example, when the target rotation speed signal SV is greater than or equal to the target rotation speed comparison signal SVX, the control unit 100 determines that the target rotation speed NV is greater than or equal to the reference target rotation speed NVX.

When determining that the target rotation speed NV is less than the reference target rotation speed NVX based on the comparison of the target rotation speed signal SV and the target rotation speed comparison signal SVX, the control unit 100 selects the falling detection mode.

For example, when the target rotation speed signal SV is less than the target rotation speed comparison signal SVX, the control unit 100 determines that the target rotation speed NV is less than the reference target rotation speed NVX.

When at least one of the selection of the detection mode based on the disconnection torque TX, the selection of the detection mode based on the target rotation speed NV, and the selection of the detection mode based on the drive shaft rotation speed NM is different from other selections, according to predetermined priorities, the control unit 100 selects the one having the highest priority among the three selections as the detection mode.

Figure 12:
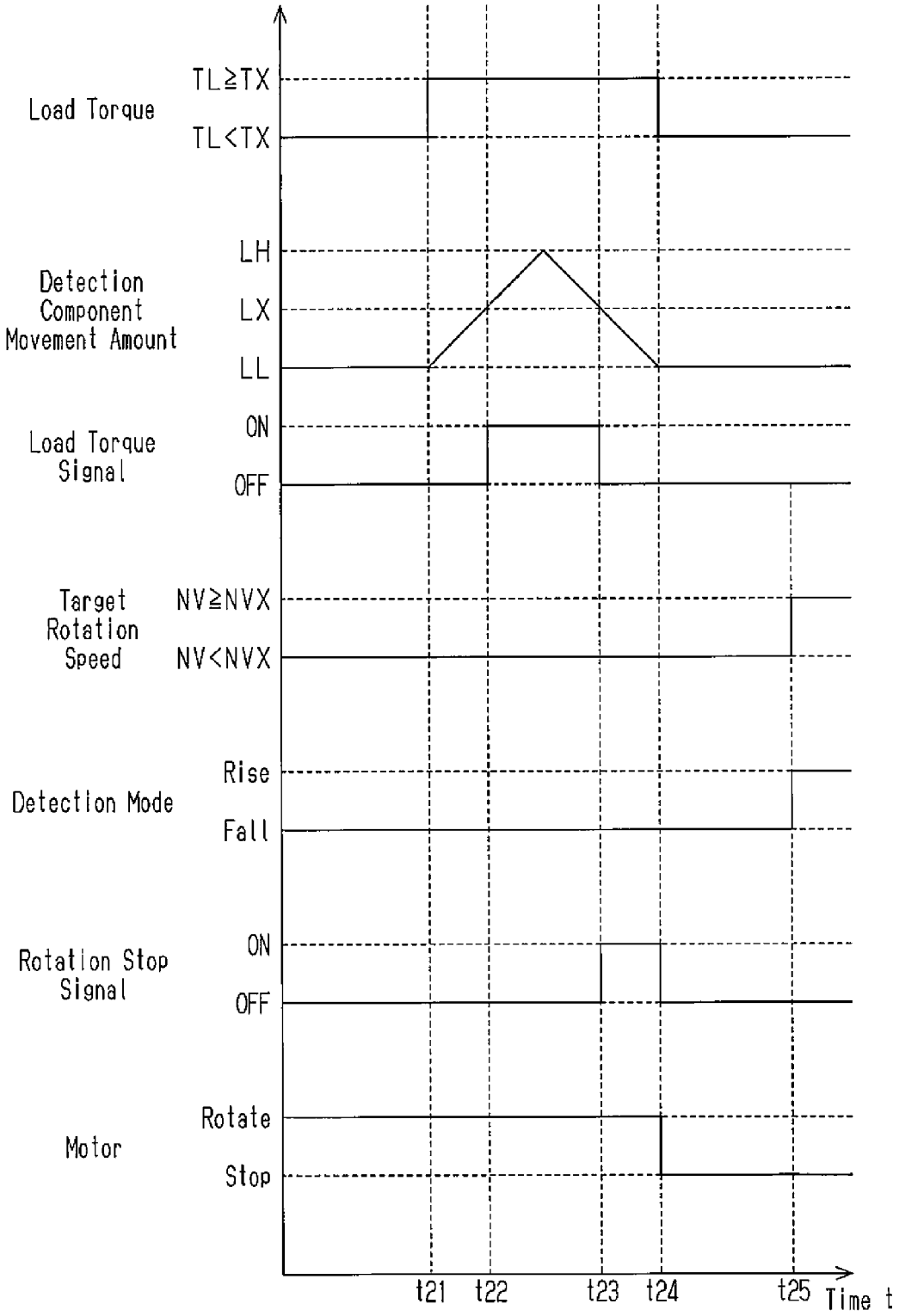
FIG. 12 is a timing chart of the operation of the electric power tool in the second embodiment.

FIG. 12 shows an example of the operation of the electric power tool 1. In this operational example, a driver serving as the bit 2 is connected to the electric power tool 1.

During a period immediately before time t21, the electric power tool 1 performs the following operation.

The trigger switch 71 is set to the maximum output position. The control unit 100 outputs the rotation driving signal SMD to the drive unit 90 according to the trigger operation signal SS. The drive unit 90 supplies current to the motor 30 according to the rotation driving signal SMD. The load torque TL is less than the disconnection torque TX. Thus, the rear-stage annular gear 43C does not rotate relative to the housing 20. Accordingly, the clutch unit 50 connects the torque transmission line between the tool drive shaft 32 and the tool output shaft 60.

The detection component 51 is located at the reference position. Thus, the load detector 81 does not output the load torque signal SL and the control unit 100 does not output the rotation stop signal SMS. The control unit 100 determines that the target rotation speed NV is less than the reference target rotation speed NVX to select the falling detection mode.

At time t21, the electric power tool 1 performs the following operation.

The load torque TL increases to the disconnection torque TX or greater. Thus, the rear-stage annular gear 43C rotates relative to the housing 20, and the clutch unit 50 disconnects the torque transmission line between the tool drive shaft 32 and the tool output shaft 60. The projections 43X rotate relative to the balls 54, and the detection component 51 is moved relative to the rear-stage annular gear 43C. As a result, the detection component movement amount L increases from the reference movement amount LL.

The detection component movement amount L has a value between the reference movement amount LL and the output switching movement LX. Since the load detector 81 does not output the load torque signal SL, the control unit 100 does not output the rotation stop signal SMS. Thus, the drive unit 90 continues to supply current to the motor 30 according to the rotation driving signal SMD.

In a period from time t21 until immediately before time t22, the electric power tool 1 performs the following operation.

The load torque TL is greater than or equal to the disconnection torque TX. The drive unit 90 supplies current to the motor 30. The rear-stage annular gear 43C rotates relative to the housing 20. The contact position of the projection 43X with the balls 54 changes according to the rotational angle of the rear-stage annular gear 43C. This increases the detection component movement amount L.

At time t22, the electric power tool 1 performs the following operation.

The detection component movement amount L increases to the output switching movement LX or greater. Thus, the load detector 81 outputs the load torque signal SL to the control unit 100. At this time, the load torque signal SL rises.

The control unit 100 determines that the target rotation speed NV is less than the reference target rotation speed NVX to select the falling detection mode. Thus, the control unit 100 does not output the rotation stop signal SMS. Accordingly, the drive unit 90 continues to supply current to the motor 30.

In a period from time t22 until immediately before time t23, the electric power tool 1 performs the following operation.

The motor 30 is rotated by the current supplied from the drive unit 90. The rear-stage annular gear 43C rotates relative to the housing 20. The contact position of the projection 43X with the balls 54 changes as the rotational angle of the rear-stage annular gear 43C changes. As a result, the detection component movement amount L increases to the upper limit movement LH and then gradually decreases.

At time t23, the electric power tool 1 performs the following operation.

The detection component movement amount L falls below the output switching movement LX. Thus, the load detector 81 stops outputting the load torque signal SL. At this time, the load torque signal SL falls.

The control unit 100 determines that the target rotation speed NV is less than the reference target rotation speed NVX to select the falling detection mode. Thus, the control unit 100 outputs the rotation stop signal SMS to the drive unit 90 based on the falling of the load torque signal SL. Accordingly, the drive unit 90 stops the supply of current to the motor 30.

At time t24, the electric power tool 1 performs the following operation.

The motor 30 and the rear-stage annular gear 43C completely stop rotation. The load torque TL falls below the disconnection torque TX. The detection component movement amount L is the reference movement amount LL. The control unit 100 calculates the drive shaft rotation speed NM according to the rotation speed detection signal SN, and determines that the drive shaft rotation speed NM is "0" to stop outputting of the rotation stop signal SMS.

At time t25, the electric power tool 1 performs the following operation.

The operation position of the rotation speed setting operation unit 74 is changed. The rotation speed setting detector 86 supplies the target rotation speed signal SV corresponding to the operation position of the rotation speed setting operation unit 74 to the control unit 100. The control unit 100 determines that the target rotation speed NV is greater than or equal to the reference target rotation speed NVX to change the falling detection mode to the rising detection mode.

The electric power tool 1 in the second embodiment has advantage (1) of the first embodiment, that is, the advantage in that the variation in the load torque TL when the motor 30 stops rotation is small. The electric power tool 1 in the second embodiment further has advantages (2) and (3) in the first embodiment. The electric power tool 1 in the second embodiment further has following advantages.

(4) When the disconnection torque TX is less than the reference disconnection torque TXN, the control unit 100 selects the rising detection mode. Thus, in a period after the balls 54 run past the first projection 43X and before the balls 54 run on the second projection 43X, the motor 30 and the rear-stage annular gear 43C completely stop rotation. Therefore, the variation in the final tightening torque TCZ becomes small.

(5) When the disconnection torque TX is greater than or equal to the reference disconnection torque TXN, the control unit 100 selects the falling detection mode. Thus, in the period after the balls 54 run past the first projection 43X and before the balls 54 run on the second projection 43X, the motor 30 and the rear-stage annular gear 43C completely stop rotation. Therefore, the variation in the final tightening torque TCZ becomes small.

(6) When the target rotation speed NV is greater than or equal to the reference target rotation speed NVX, the control unit 100 selects the rising detection mode. Thus, in the period after the balls 54 run past the first projection 43X and before the balls 54 run on the second projection 43X, the motor 30 and the rear-stage annular gear 43C completely stop rotation. Therefore, the variation in the final tightening torque TCZ becomes small.

(7) When the target rotation speed NV is less than the reference target rotation speed NVX, the control unit 100 selects the falling detection mode. Thus, in the period after the balls 54 run past the first projection 43X and before the balls 54 run on the second projection 43X, the motor 30 and the rear-stage annular gear 43C completely stop their rotation. Therefore, the variation in the final tightening torque TCZ becomes small.

It should be apparent to those skilled in the art that the present invention may be embodied in many other specific forms without departing from the spirit or scope of the invention. Particularly, it should be understood that the present invention may be embodied in the following forms.

In the first embodiment, the load detector 81 indirectly detects the load torque TL acting on the tool output shaft 60. Instead, a load detector 81 in a modification example directly detects the load torque TL, and supplies the load torque signal SL corresponding to the load torque TL to the control unit 100. An example of the load detector 81 that directly detects the load torque TL is a torque sensor. The load detector 81 in the second embodiment can be also modified in the same manner.

In the first embodiment, the load detector 81 controls the output of the load torque signal SL according to the relationship between the detection component movement amount L and the output switching movement LX.

Instead, a load detector 81 in a modification example controls the output of the load torque signal SL such that the timing at which the load torque signal SL is output while the detection component movement amount L increases differs from the timing at which the output of the load torque signal SL is stopped while the detection component movement amount L decreases.

Specifically, when the detection component movement amount L increases to a first output switching movement or greater, the load detector 81 in the modification example outputs the load torque signal SL.

When the detection component movement amount L falls below a second output switching movement, the load detector 81 in the modification example stops the output of the load torque signal SL. The second output switching movement is set to differ from the first output switching movement.

For example, the first output switching movement may be larger than the second output switching movement. Alternatively, the first output switching movement may be smaller than the second output switching movement. The load detector 81 in the second embodiment may also be modified in the same manner.

In the first embodiment, the rotation speed detector 82 outputs the rotation speed detection signal SN corresponding to the rotation speed of the tool drive shaft 32. Instead, a rotation speed detector 82 in a modification example outputs the rotation speed detection signal SN corresponding to the rotation speed of the tool output shaft 60. The rotation speed detector 82 in the second embodiment can be also modified in the same manner.

In the first embodiment, the control unit 100 detects falling of the load torque signal SL in the falling detection mode to output the rotation stop signal SMS. Instead, the control unit 100 may detect rising of the load torque signal SL in the falling detection mode and then, detect falling of the load torque signal SL and output the rotation stop signal SMS based on the two detections. The control unit 100 in the second embodiment can be also modified in the same manner.

In the first embodiment, the stopping of the motor 30 is controlled by using hardware. Instead, the stopping of a motor 30 in a modification example may be controlled by using software or a combination of software and hardware. When using software, the control unit 100 executes a program to control the stopping of the motor 30. The control for stopping the motor 30 in the second embodiment can also be modified in the same manner.

In the second embodiment, the electric power tool 1 controls the motor 30 according to the target rotation speed signal SV, thereby causing the drive shaft rotation speed NM to converge to the target rotation speed NV. Alternatively, an electric power tool 1 in a modification example has a rotation speed change mechanism in lieu of the rotation speed setting operation unit 74. In this case, a power transmission unit 40 in the modification example has a deceleration ratio change structure for changing a deceleration ratio. For example, the deceleration ratio change structure moves gears of the power transmission unit 40 with respect to the other gears, thereby changing the engagement between the gears. The rotation speed change mechanism moves gears of the power transmission unit 40, thereby changing the deceleration ratio of the power transmission unit 40. The rotation speed setting detector 86 supplies a signal corresponding to the gear movement in the power transmission unit 40, serving as the target rotation speed signal SV, to the control unit 100.

In the second embodiment, the control unit 100 selects the detection mode based on the setting torque signal ST. Instead, to control the stopping of the motor 30, a control unit 100 in a modification example does not use the setting torque signal ST.

In the second embodiment, the control unit 100 selects the detection mode according to the target rotation speed signal SV. Instead, to control stopping of the motor 30, a control unit 100 in a modification example does not use the target rotation speed signal SV.

In the second embodiment, the electric power tool 1 includes the controller 200 having the reference setting operation unit 210 and the reference setting detector 220. Instead, in an electric power tool 1 in a modification example, an electric power tool body 10 includes the reference setting operation unit 210 and the reference setting detector 220, and does not include the controller 200.

The invention claimed is:

1. An electric power tool comprising:

a motor including a drive shaft;

a tool output shaft arranged to be rotated by rotational force of the drive shaft;

a clutch unit configured to connect or disconnect a torque transmission line between the drive shaft and the tool output shaft in accordance with a load torque of the tool output shaft;

a load detector configured to output a load torque signal in accordance with the load torque of the tool output shaft; and a control unit capable of performing a rising detection mode, which stops rotation of the motor when detecting a rising in the load torque signal, and a falling detection mode, which stops rotation of the motor when detecting a falling in the load torque signal, wherein the control unit is configured to select the rising detection mode or the falling detection mode based on a usage condition signal indicating a usage condition of the electric power tool.

2. The electric power tool according to claim 1, further comprising:

a condition setting operation unit serving as a human-machine interface; and a condition setting detector configured to output a signal corresponding to the operation of the condition setting operation unit as the usage condition signal.

3. The electric power tool according to claim 2, wherein the condition setting operation unit includes a rotation speed setting operation unit, the condition setting detector includes a rotation speed setting detector, the rotation speed setting detector is configured to output a target rotation speed signal, corresponding to the operation of the rotation speed setting operation unit, as the usage condition signal, and the control unit is configured to control a rotation speed of the motor and select the rising detection mode or the falling detection mode based on the target rotation speed signal.

4. The electric power tool according to claim 3, wherein the control unit is configured to compare the target rotation speed signal with a target rotation speed comparison signal, and select the falling detection mode when the comparison indicates that a target rotation speed set by the rotation speed setting operation unit is less than a reference target rotation speed.

5. The electric power tool according to claim 2, wherein the condition setting operation unit includes a torque setting operation unit, the condition setting detector includes a torque setting detector, the torque setting detector is configured to output a setting torque signal, corresponding to the operation of the torque setting operation unit, as the usage condition signal, and the control unit is configured to select the rising detection mode or the falling detection mode based on the setting torque signal.

6. The electric power tool according to claim 5, wherein the control unit is configured to compare the setting torque signal with a setting torque comparison signal, and select the falling detection mode when the comparison indicates that a disconnection torque set by the torque setting operation unit is greater than or equal to a reference disconnection torque.

7. The electric power tool according to claim 1, further comprising:

a rotation speed detector configured to output a rotation speed detection signal, corresponding to a rotation speed of the drive shaft or a rotation speed of the tool output shaft, as the usage condition signal, wherein the control unit is configured to select the rising detection mode or the falling detection mode based on the rotation speed detection signal.

8. The electric power tool according to claim 7, wherein the control unit is configured to calculate a rotation speed calculation value based on the rotation speed detection signal, compare the rotation speed calculation value with a rotation speed calculation value comparison signal, and select the falling detection mode when the comparison indicates that the rotation speed of the drive shaft or the rotation speed of the tool output shaft is less than a reference rotation speed.

9. The electric power tool according to claim 8, further comprising:

a reference setting operation unit serving as a human-machine interface; and a reference setting detector configured to output a reference rotation speed signal, corresponding to the operation of the reference setting operation unit, as the usage condition signal, wherein the control unit is configured to change the reference rotation speed based on the reference rotation speed signal.

* * * * *